US007610195B2

(12) United States Patent
Ojanperä

(10) Patent No.: US 7,610,195 B2
(45) Date of Patent: Oct. 27, 2009

(54) DECODING OF PREDICTIVELY CODED DATA USING BUFFER ADAPTATION

(75) Inventor: Juha Ojanperä, Nokia (FI)

(73) Assignee: Nokia Corporation, Espoo (FI)

( * ) Notice: Subject to any disclaimer, the term of this patent is extended or adjusted under 35 U.S.C. 154(b) by 642 days.

(21) Appl. No.: 11/421,541

(22) Filed: Jun. 1, 2006

(65) Prior Publication Data

US 2007/0282600 A1 Dec. 6, 2007

(51) Int. Cl.
*G10L 19/12* (2006.01)

(52) U.S. Cl. ..... 704/200.1

(58) Field of Classification Search ..... 704/200.1
See application file for complete search history.

(56) References Cited

U.S. PATENT DOCUMENTS

| | | | | |
|---|---|---|---|---|
| 5,832,426 | A | 11/1998 | Tsutsui et al. | |
| 6,012,025 | A | 1/2000 | Yin | |
| 6,208,276 | B1 | 3/2001 | Snyder | |
| 6,842,735 | B1 | 1/2005 | Covell et al. | |
| 7,162,419 | B2 * | 1/2007 | Ojanpera | 704/219 |
| 7,457,743 | B2 * | 11/2008 | Ojanpera | 704/206 |
| 2002/0173969 | A1 | 11/2002 | Ojanpera | |
| 2003/0009328 | A1 | 1/2003 | Ojanpera | |
| 2005/0252361 | A1 | 11/2005 | Oshikiri | |

FOREIGN PATENT DOCUMENTS

| | | |
|---|---|---|
| CA | 2586251 | 5/2006 |
| DE | 19509149 A1 | 9/1996 |
| WO | WO 98/35447 | 8/1998 |
| WO | WO 00/39933 | 7/2000 |
| WO | WO 00/51243 | 8/2000 |
| WO | WO 01/59603 | 8/2001 |

OTHER PUBLICATIONS

International Search Report and Written Opinion mailed Dec. 14, 2007 for PCT/IB2007/001351.

3GPP TS 26.402; 3rd Generation Partnership Project; Technical Specification Group Services and System Aspects; General Audio Codec audio processing functions; Enhanced aacPlus general audio codec; Additional decoder tools, Release 6, V6.1.0, Sep. 2005.

Smithers, Michael J., et al. "Increased Efficiency MPEG-2 AAC Encoding," Audio Engineering Society Convention Paper 5490, published prior to Apr. 26, 2006, pp. 1-7.

(Continued)

*Primary Examiner*—Susan McFadden
(74) *Attorney, Agent, or Firm*—Banner & Witcoff, Ltd.

(57) ABSTRACT

A decoder (e.g., an AAC-LTP decoder) receives a stream containing coded audio data and prediction data. The coded data is upsampled or downsampled during decoding. Portions of the decoded data are stored in a buffer for use in decoding subsequent coded data. The buffer into which the decoded data is placed has different dimensions than a buffer used in a coder when generating the coded data. A portion of the data in the decoder buffer is identified and modified with interleaved zero values so as to correspond to the dimensions of the prediction coding buffer in the coder.

37 Claims, 15 Drawing Sheets

OTHER PUBLICATIONS

Advanced Audio Coding, <http://en.wikipedia.org/wiki/Advanced_Audio_Coding>, published on or before Apr. 21, 2006, 5 pages.
Grill, Bernhard, "The MPEG-4 General Audio Coder," published prior to Apr. 26, 2006, pp. 147-156.
Brandenburg, Karlheinz, et al., "MPEG-4 Natural Audio Coding," 2000, pp. 423-444.
Bosi, Marina, et al., "ISO/IEC MPEG-2 Advanced Audio Coding,", published prior to Apr. 26, 2006, 43 pages.
Ojanperä, Juha, et al., "Long Term Predictor for Transform Domain Perceptual Audio Coding," published prior to Apr. 26, 2006, 26 pages.
Brandenburg, Karlheinz, "MP3 and AAC Explained," first date of publication unknown, but prior to Jun. 1, 2006, pp. 1-12.
Painter, Ted, et al., "Perceptual Coding of Digital Audio," Apr. 2000, Proceedings of the IEEE, vol. 88, No. 4, pp. 451-513.
International Standard ISO/IEC 14496-3, Information technology-Coding of audio-visual objects-, Dec. 1, 2005, 1138 pages.

* cited by examiner

DECODING OF PREDICTIVELY CODED DATA USING BUFFER ADAPTATION

FIELD OF THE INVENTION

The invention generally relates to decoding of compressed digital information. In particular, at least some embodiments of this invention relate to decoding of bit streams representing content that has been compressed using one or more techniques that employ long-term predictive coding.

BACKGROUND OF THE INVENTION

In order to minimize the amount of data that must be stored and/or transmitted across a communication channel, content (e.g., audio and/or video information) is often compressed into a data stream with fewer bits than might otherwise be needed. Numerous methods for such compression have been developed. Some of those methods employ predictive coding techniques. For example, the Advanced Audio Coding (AAC) format specified by various Motion Picture Experts Group (MPEG) standards includes several sets of tools for coding (and subsequently decoding) audio content (e.g., music). Those tools, or profiles, include the Main, LC (Low Complexity), SSR (Scalable Sampling Rate) and LTP (Long-Term Prediction) profiles. LTP encoding can provide higher quality audio to the end-user, but at a price of increased computational requirements. This can result in a need for additional memory and processing hardware in a device such as a mobile phone or digital music player. Moreover, commercial necessity can require that devices intended to decode and play AAC audio data be able to accommodate multiple profiles. For example, users frequently wish to download music from a variety of sources. Some of those sources may encode music using the AAC-LC profile, while others may encode music using the AAC-LTP profile.

FIG. 1A is a block diagram showing a general structure for an AAC-LTP encoder. Although the operation of such encoders (and some corresponding decoders) is well known, the following overview is included to provide context for subsequent description. An incoming time domain audio signal is received by a long-term predictor 1, a modified discrete cosine transform (MDCT) 2, and by a psychoacoustic model 3. Long-term predictor 1 generates data (prediction coefficients and a pitch lag) that can be used to predict the currently input time-domain signal based on time domain signals for earlier portions of the audio stream. Time domain versions of those earlier portions are received as inputs from inverse modified discrete cosine transform (IMDCT) 4 and from a synthesis filter bank (not shown), and are stored by the long-term predictor in a buffer (also not shown in FIG. 1A). The prediction coefficients and pitch lag are provided by long-term predictor 1 to bit stream multiplexer 11. The predicted audio (i.e., the time domain audio signal that would result from the calculated prediction coefficients and pitch lag) is converted to the frequency domain by MDCT 5.

The incoming time domain audio is also provided to a separate MDCT 2. Unlike MDCT 5, which only transforms the predicted version of that audio, the original incoming audio signal is converted to the frequency domain by MDCT 2. The output from MDCT 2 is provided to a frequency selective switch (FSS) 7 (discussed below) and to a summer 6. Summer 6 computes a difference between the output of MDCT 5 (the frequency domain version of the predicted audio signal) and the output of MDCT 2 (the frequency domain version of the original audio signal). In effect, the output from summer 6 (or prediction error) is the difference between the actual audio signal and the predicted version of that same signal. The prediction error output from summer 6 is provided to FSS 7.

FSS 7 receives control inputs from psychoacoustic model 3. Psychoacoustic model 3 contains experimentally-derived perceptual data regarding frequency ranges that are perceptible to human listeners. Psychoacoustic model 3 further contains data regarding certain types of audio patterns that are not well modeled using long-term prediction. For example, fast changing or transient signal segments can be difficult to model by prediction. Psychoacoustic model 3 examines the incoming audio signal in the time domain and evaluates which sub-bands should be represented by prediction error (from summer 6), prediction coefficients (from predictor 1) and pitch lag (also from predictor 1), as well as which sub-bands should be represented by MDCT coefficients of the original audio (from MDCT 2). Based on data from psychoacoustic model 3, FSS 7 selects data to be forwarded to block 8 for quantization and coding. For sub-bands where prediction is to be used, the prediction error coefficients from summer 6 are forwarded to quantizer/coder 8. For other sub-bands, the MDCT 2 output is forwarded to quantizer/coder 8. A control signal output from FSS 7 includes a flag for each sub-band indicating whether long-term prediction is enabled for that sub-band.

The signals from FSS 7 are then quantized in quantizer/encoder 8 (e.g., using Huffman coding). Perceptual data from psychoacoustic model 3 is also used by quantizer/encoder 8. The output from quantizer/encoder 8 is then multiplexed in block 11 with control data from long-term predictor 1 (e.g., predication coefficients and pitch lag) and FSS 7 (sub-band flags). From block 11 the multiplexed data is then provided to a communication channel (e.g., a radio or internet transmission) or storage medium. The output from quantizer/coder 8 is also provided to inverse quantizer 9. The output of inverse quantizer 9 is forwarded to inverse frequency selective switch (IFSS) 10, as is the output from MDCT 5 and control signals (sub-band flags) from FSS 7. IFSS 10 then provides, as to each sub-band for which quantized prediction error coefficients were transmitted on the bit stream, the sum of the de-quantized prediction error coefficients and the output from MDCT 5. As to each sub-band for which the quantized MDCT 2 output was transmitted on the bit stream, IFSS provides the dequantized MDCT 2 output. The output from IFSS is then converted back to the time domain by IMDCT 4. The time domain output from IMDCT 4 is then provided to long-term predictor 1. A portion of the IMDCT 4 output is stored directly in the prediction buffer described above; other portions of that buffer hold fully-reconstructed (time domain) audio data frames generated by overlap-add (in the synthesis filter bank) of output from IMDCT 4.

FIG. 1B is a block diagram showing a general structure for an AAC-LTP decoder. The incoming bit stream is demultiplexed in block 15. The sub-band flags from FSS 7 (FIG. 1A) are provided to IFSS 17. The prediction coefficients and pitch lag from long-term predictor 1 in FIG. 1A are provided to pitch predictor 20. The quantized data from FSS 7 in FIG. 1A is dequantized in inverse quantizer 16, and then provided to IFSS 17. Based on the corresponding sub-band flag values, IFSS 17 determines whether long-term prediction was enabled for various sub-bands. For sub-bands where prediction was not enabled, IFSS 17 simply forwards the output of inverse quantizer 16 to IMDCT 18. For sub-bands where prediction was enabled, IFSS 17 adds the output of inverse quantizer 16 (i.e., the dequantized the prediction error coefficients) to the output of MDCT 21 (discussed below), and forwards the result to IMDCT 18. IMDCT 18 then transforms the output of IFSS 17 back to the time domain. The output of IMDCT 18 is then used for overlap-add in a synthesis filter bank (not shown) to yield a fully-reconstructed time domain signal that is a close replica of the original audio signal input in FIG. 1A. This fully-reconstructed time domain signal can then be processed by a digital to analog converter (not shown in FIG. 1B) for playback on, e.g., one or more speakers.

Recent portions of the time domain output from IMDCT 18 and of the fully reconstructed time domain signal from the synthesis filter bank are also stored in long-term prediction (LTP) buffer 19. LTP buffer 19 has the same dimensions as, and is intended to replicate the contents of, the buffer within the long-term predictor 1 of FIG. 1A. Data from LTP buffer 19 is used by pitch predictor 20 (in conjunction with prediction coefficients and pitch lag values) to predict the incoming audio signal in the time domain. The output of pitch predictor 20 corresponds to the output of long-term predictor 1 provided to MDCT 5 in FIG. 1A. The output from pitch predictor 20 is then converted to the frequency domain in MDCT 21, with the output of MDCT 21 provided to IFSS 17.

The conventional structure of LTP buffer 19 (as prescribed by the applicable MPEG-4 standards) is shown in FIG. 1C. Frame t−1 is the most recent fully-reconstructed time domain signal formed by overlap-add of time domain signals in the synthesis filter bank (not shown) of the decoder. Frame t is the time domain signal output from IMDCT 18, and is the aliased time domain signal to be used for overlap-add in the next frame to be output by the synthesis filter bank. Frame t−2 is the fully-reconstructed frame from a previous time period. The dimension (or length) N of each frame is 1024 samples. The broken line block on the right side of the LTP buffer represents a frame of 1024 zero-amplitude samples. This all-zero block is not an actual part of LTP buffer 19. Instead, it is used to conceptually indicate the location of the zero lag point. Specifically, when the value for pitch lag is at its maximum, 2048 time domain samples are predicted based on the 2048 samples in frames t−1 and t−2. When the pitch lag is between the minimum and maximum (e.g., at the point indicated as lag L), the 2048 samples prior to the pitch lag location (i.e., to the right of point L in FIG. 1C) are used to predict 2048 samples. When pitch lag is less that 1024, zeros are used for "samples" 1023 and below from the LTP buffer. For example, when the pitch lag is at its minimum (zero lag), the 1024 samples in the t frame and 1024 zero amplitude samples are used to predict 2048 samples. Although the use of the all-zero amplitudes results in less accurate sound reproduction, less memory is needed for the LTP buffer. Because zero or very low lag values occur relatively infrequently, overall sound quality is not seriously affected.

A decoder such as in FIG. 1B and the associated LTP buffer of FIG. 1C are often used in a mobile device such as a portable music player or mobile terminal. Such devices frequently have limited computational and memory resources. Adding additional memory and processing capacity is often expensive, thereby increasing overall cost of the device. Because a decoder and buffer use significant amounts of those resources, there may be limited excess capacity to accommodate additional features. For example, it is often desirable for audio playback devices to have a fast forward capability. If the output rate of the audio decoder is increased, numerous decoding operations must be performed at an even higher rate. As another example, a device that is decoding and playing an audio stream may need to briefly perform some other task (e.g., respond to an incoming telephone call or other communication). Unless processing and memory capacity is increased, or unless the processing and memory needed for audio decoding and playback can be reduced, the device may be unable to simultaneously perform multiple tasks.

SUMMARY OF THE INVENTION

This Summary is provided to introduce a selection of concepts in a simplified form that are further described below in the Detailed Description. This Summary is not intended to identify key or essential features of the claimed subject matter, nor is it intended to be used as an aid in determining the scope of the claimed subject matter.

At least some embodiments of the invention include a method for processing data that has been coded, using predictive techniques, based on previous data in a prediction coding buffer having known dimensions. After coding and transmission (and/or storage), a decoder receives a stream containing the coded data and predictive information that resulted from the coding predictions. The decoder further receives a factor that indicates whether (and by what amount) the coded data is to be upsampled or downsampled during the decoding process. As the coded data is decoded, portions of the decoded data are stored in a buffer for use in decoding subsequent coded data based on subsequent predictive information. The buffer into which the decoded data is placed has different dimensions than the buffer used during the prediction operations performed by the coder. A portion of the data in the decoder buffer is identified and then modified so as to correspond to the prediction coding buffer dimensions. In some embodiments, that modification includes interleaving zero values between elements of the identified data.

In certain embodiments, the coded data is in the frequency domain, and the decoding includes conversion to the time domain. In some such embodiments, the modified data from the decoder buffer is first converted to the frequency domain. That converted and modified data is then scaled and added to frequency domain prediction error coefficients, with the resulting values then converted into the time domain.

In at least some embodiments, a decoder accommodates upsampling during the decoding of the coded data. As the coded data is decoded, only selected samples from a frame of fully reconstructed time domain samples are stored in a buffer frame corresponding to current data.

BRIEF DESCRIPTION OF THE DRAWINGS

The foregoing summary of the invention, as well as the following detailed description of illustrative embodiments, is better understood when read in conjunction with the accompanying drawings, which are included by way of example, and not by way of limitation with regard to the claimed invention.

DETAILED DESCRIPTION OF THE PREFERRED EMBODIMENTS

Although embodiments of the invention will be described by example of communications in accordance with the Advanced Audio Coding (AAC) format and the Long-Term Prediction (LTP) profile thereof, as defined by the Motion Picture Experts Group MPEG-4 standard (ISO-14496), the invention is not limited in this regard. In particular, the invention is also applicable to other coding schemes in which a coded data stream has been generated using predictive coding methods.

Figure 2:
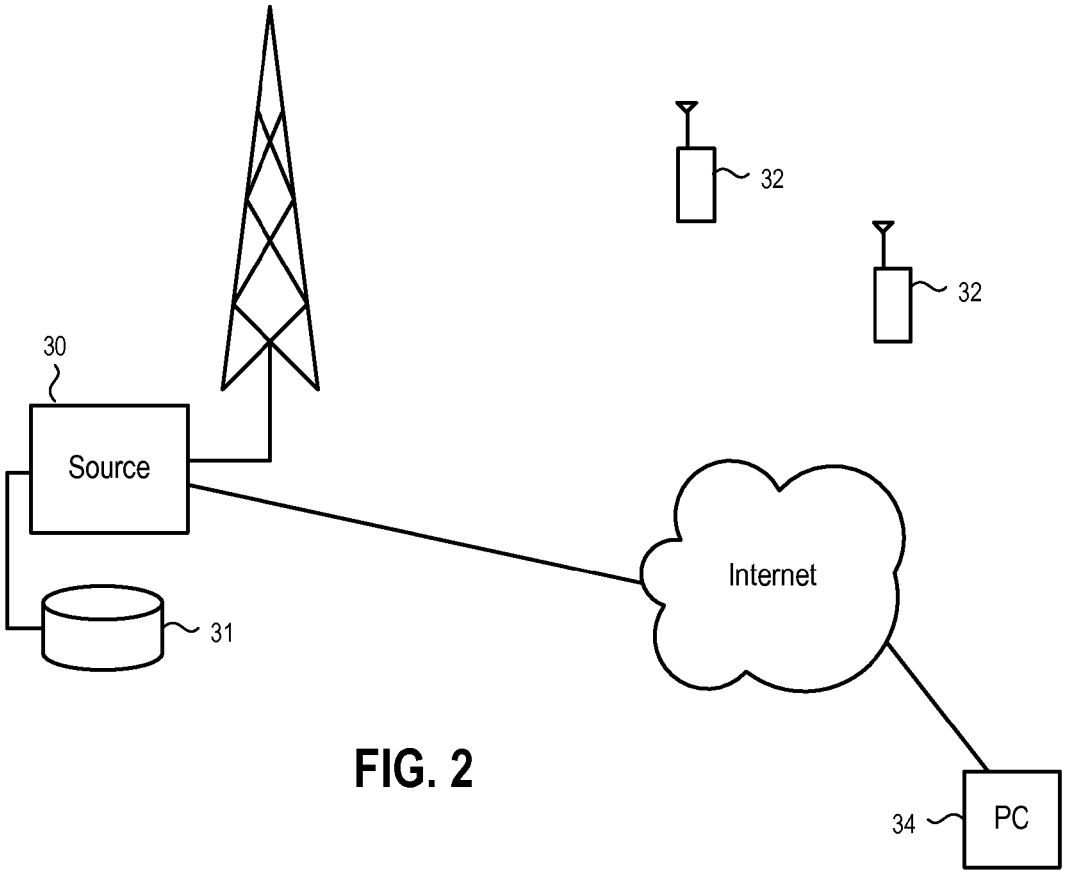
FIG. 2 is a block diagram of one example of a system in which embodiments of the invention can be employed.

FIG. 2 is a block diagram of one example of a system in which embodiments of the invention can be employed. Source 30 outputs AAC-LTP compressed audio signals for transmission to remote users. Source 30 may produce that AAC-LTP output by real time processing of an input audio signal (not shown), or by accessing previously compressed audio that has been stored in database 31. Source 30 transmits AAC-LTP audio wirelessly to mobile devices 32 (e.g., mobile telephones configured to receive and decode compressed audio signals from source 30). Mobile devices 32 may be communicating within a long-range wireless network (e.g., a mobile telephone network, a 3GPP network, etc.), may be communicating in a short range wireless network (e.g., a BLUETOOTH network), may be communicating via a wireless internet link, may be receiving broadcast transmissions (e.g., satellite radio), etc. Source 30 also provides compressed AAC-LTP over a wired network (e.g., a wired internet connection) for download by devices such as personal computer 34.

Figure 3:
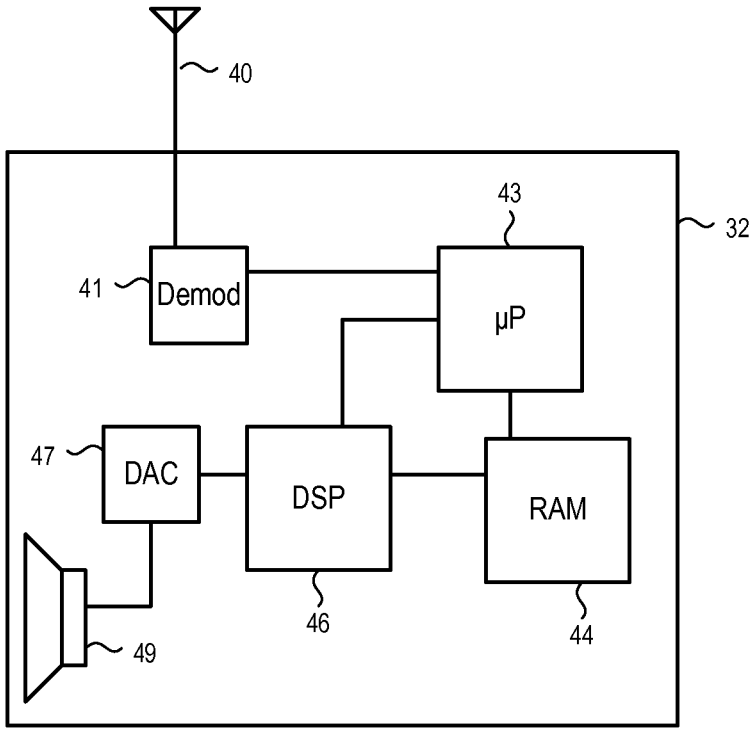
FIG. 3 is a block diagram showing one example of a mobile device configured to receive and decode audio signals according to at least some embodiments.

FIG. 3 is a block diagram showing one example of a mobile device 32 configured to receive and decode AAC-LTP audio signals according to at least some embodiments. Wireless transmissions from source 30 are received via antenna 40. The incoming radio signal is demodulated and otherwise processed in block 41 to so as to recover the transmitted digital data bit stream. Controller 43 (e.g., a microprocessor) receives the recovered digital signal from block 41. Controller 43 separates the control signals (e.g., prediction coefficients and pitch lag, sub-band flags) from the quantized frequency domain components corresponding to the output from an FSS in source 30 similar to FSS 7 of FIG. 1A. Controller 43 dequantizes those frequency domain components and provides those components (with the control signals) to a digital signal processor (DSP) 46. DSP 46 then uses that data, in a manner discussed below, to generate a time domain signal. The time domain signal from DSP 46 is provided to a digital to analog converter (DAC) 47 and output via a speaker 49. Random access memory 44 is used to store instructions for operation of controller 43 and 46, as well as for data buffering (e.g., for use as an LTP buffer). Read-only memory (ROM) may also be used to store programming instructions for controller 43 and/or DSP 46.

The configuration of FIG. 3 is merely one example. In other embodiments, a separate DSP may not be included, with all processing performed by a single processor. Separate RAM may also be omitted, with a controller and/or DSP instead having internal RAM. Controller 43, DSP 46 and RAM 44 will typically be in the form of one or more integrated circuits ("chips" or a "chip set").

Figure 1A:
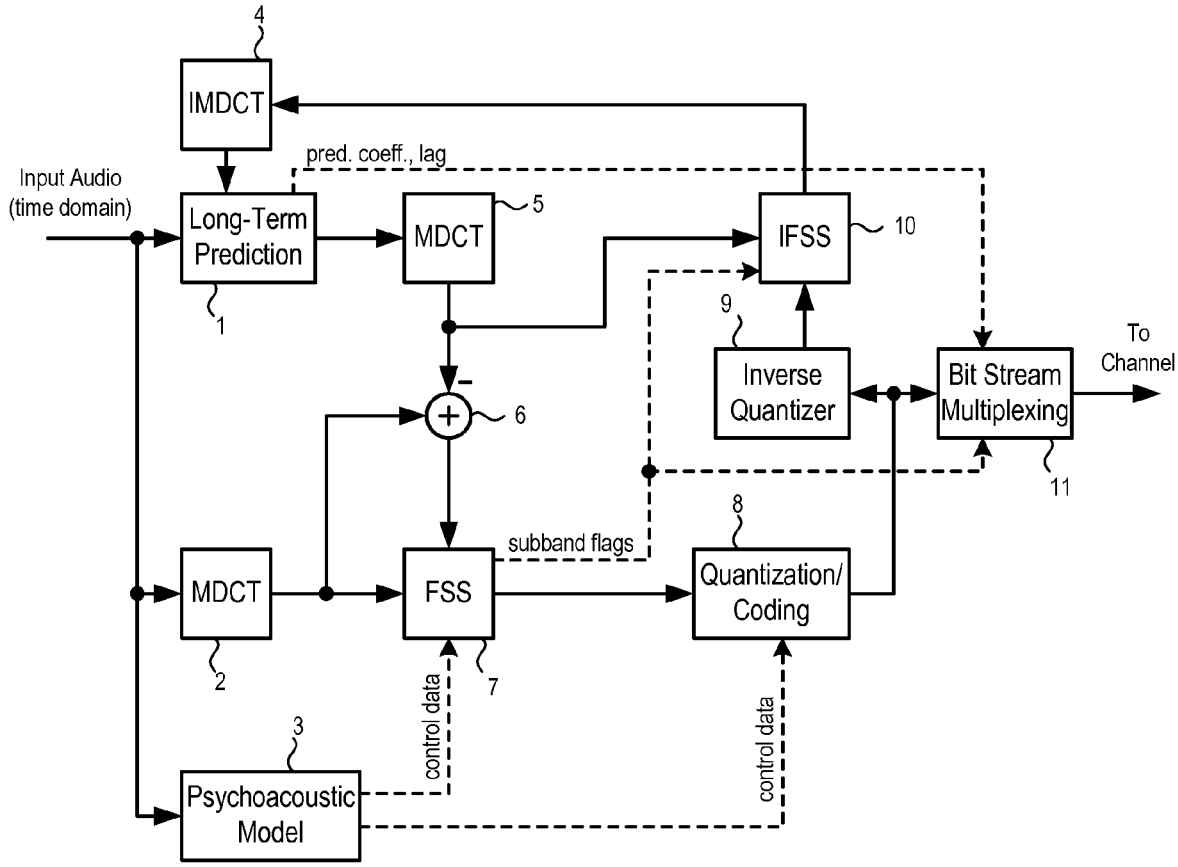
FIG. 1A Prior Art
FIG. 1A is a block diagram showing a general structure for a conventional AAC-LTP encoder.
Figure 4:
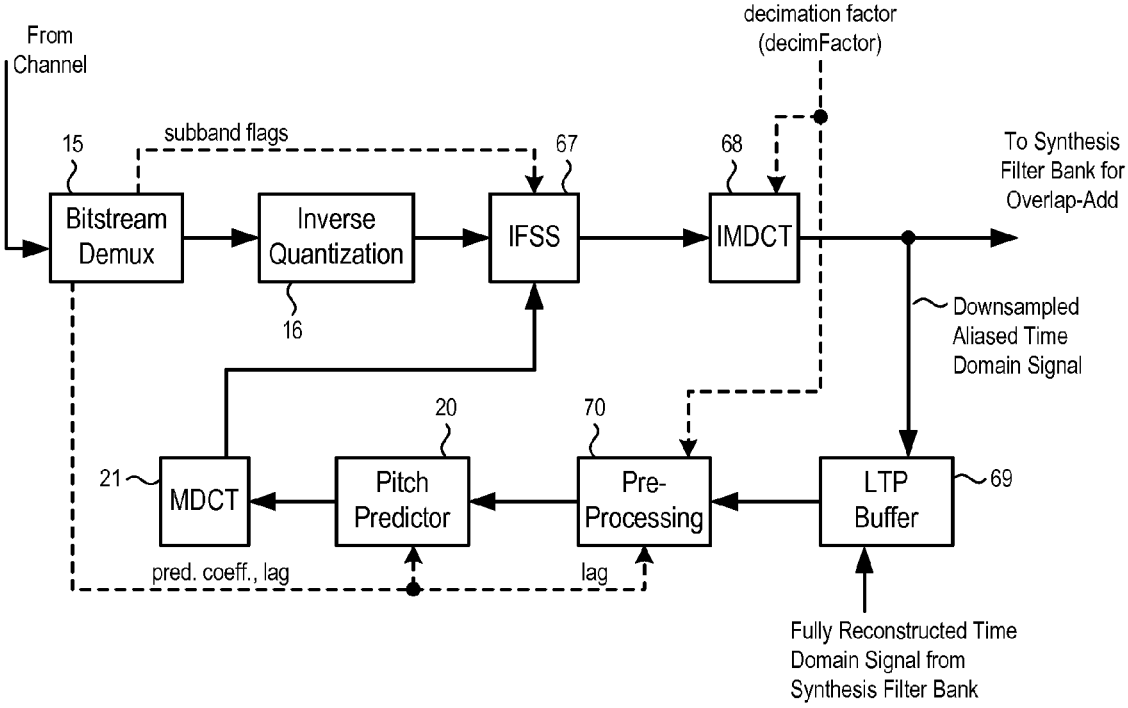
FIG. 4 is a block diagram of a decoder, according to at least some embodiments, adapted to accommodate downsampling.

FIG. 4 is a block diagram of a decoder according to at least some embodiments of the invention, and which decodes a signal from a conventional coder such as that shown in FIG. 1A. In some embodiments, operations represented by the blocks 67, 68, 70, 20 and 21 of FIG. 4 (as well as a synthesis filter bank and other elements not shown in FIG. 4) are implemented by performance of programming instructions by DSP 46, with block 69 (LTP buffer) implemented in separate RAM 44. As indicated above, however, one or more of blocks 67, 68, 70, 20 and 21 (and/or other elements) can alternately be implemented by execution of programming instructions in controller 43. Similarly, RAM 69 could be included within DSP 46 and/or controller 43 instead of separate RAM 44.

Figure 1B:
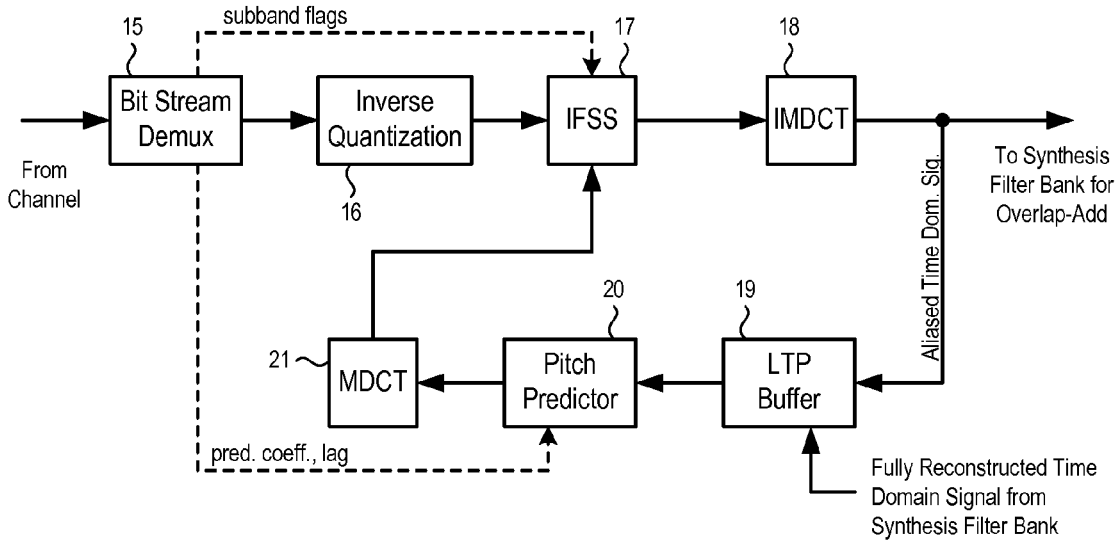
FIG. 1B Prior Art
FIG. 1B is a block diagram showing a general structure for a conventional AAC-LTP decoder.

Bit stream demultiplexer 15, inverse quantizer 16, pitch predictor 20 and MDCT 21 operate similar to like-numbered components in FIG. 1B. IFSS 67 is capable of performing the functions of IFSS 17 in FIG. 1B, but is also able to perform additional operations as described below. IMDCT 68 is capable of functioning in a manner similar to IMDCT 18 of FIG. 1B. However, IMDCT 68 is further configured, in response to an input decimation factor (decimFactor), to perform downsampling with regard to the output audio. Specifically, IMDCT 68 reduces by decimFactor the number of MDCT coefficients that are processed when converting a frequency domain signal back to the time domain. When downsampling is performed, the number of samples in the frames stored in LTP buffer 69 is also affected. When decimFactor=2, for example, each frame in LTP buffer 69 is only 512 samples in length (vs. 1024 samples in conventional LTP buffers). Although downsampling reduces the number of computations performed in IMDCT 68 and reduces the amount of memory needed for the LTP buffer, a separate problem is introduced. In particular, a downsampled LTP buffer will not match the buffer of the long-term predictor in the AAC-LTP coder that originally produced the coded signal. Unless additional steps are taken, an audio signal subcomponent based on the contents of LTP buffer 69 will not match the corresponding audio signal subcomponent predicted in the coder.

Figure 1C:
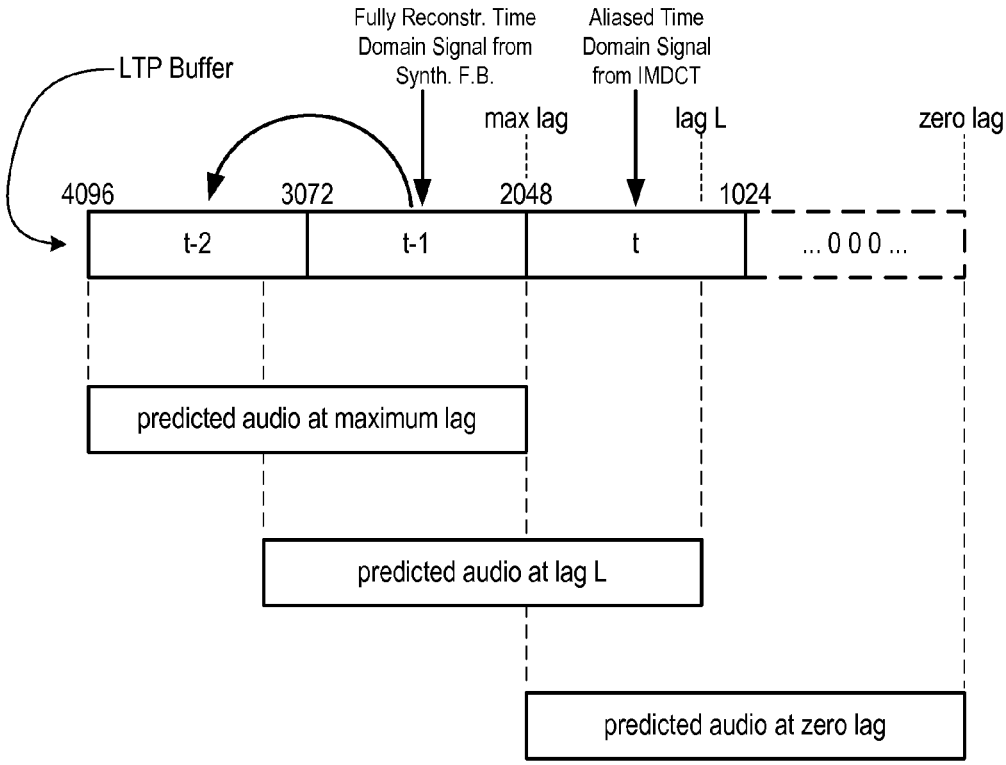
FIG. 1C Prior Art
FIG. 1C is a block diagram for a conventional LTP buffer in the decoder of FIG. 1B.
Figure 5:
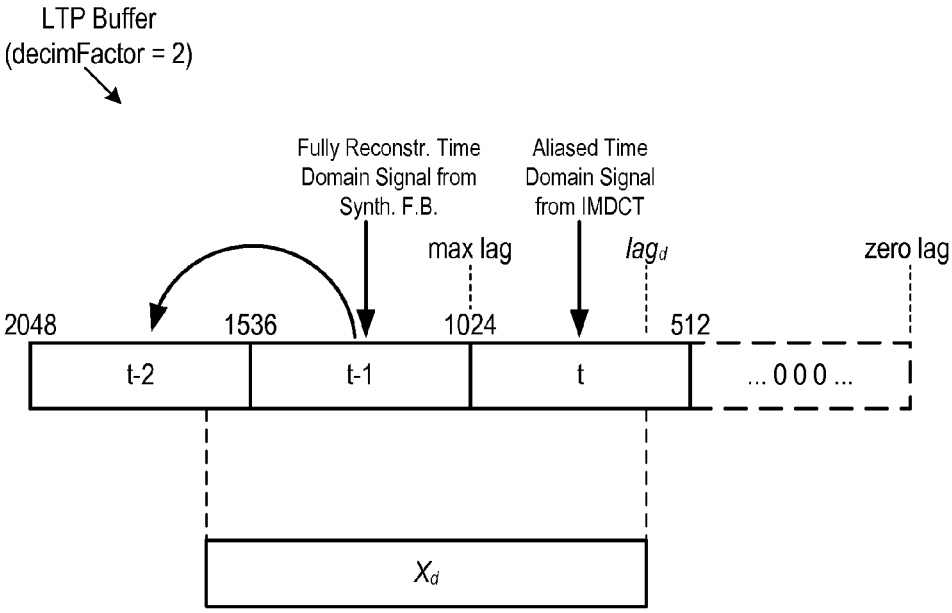
FIG. 5 shows the LTP buffer from the decoder of FIG. 4 when the decimation factor is 2.

FIG. 5 shows LTP buffer 69 when decimFactor=2. In a manner similar to the conventional LTP buffer of FIG. 1C, the t frame is filled with aliased time domain signal outputs from IMDCT 68, with frame t−1 filled from the most recent fully-reconstructed time domain frame output by the synthesis filter bank. Because of downsampling, and as indicated above, the frames of LTP buffer 69 are shorter than the frames in the coder LTP buffer. In order to adapt to this mismatch, a portion $X_d$ of LTP buffer 69 is first identified in at least some embodiments. Specifically, an offset value ($lag_d$) is computed based on the pitch lag value transmitted from the coder. $X_d$ is then populated with the contents of LTP buffer 69 starting at $lag_d$ and proceeding back in time (to the left in FIG. 5) for two frame lengths of the current LTP buffer 69 (1024 samples in the example of FIG. 5). The samples of $X_d$ are then expanded by preprocessor 70, in a manner described below, so as to more closely match the LTP buffer in the coder.

Figure 6A:
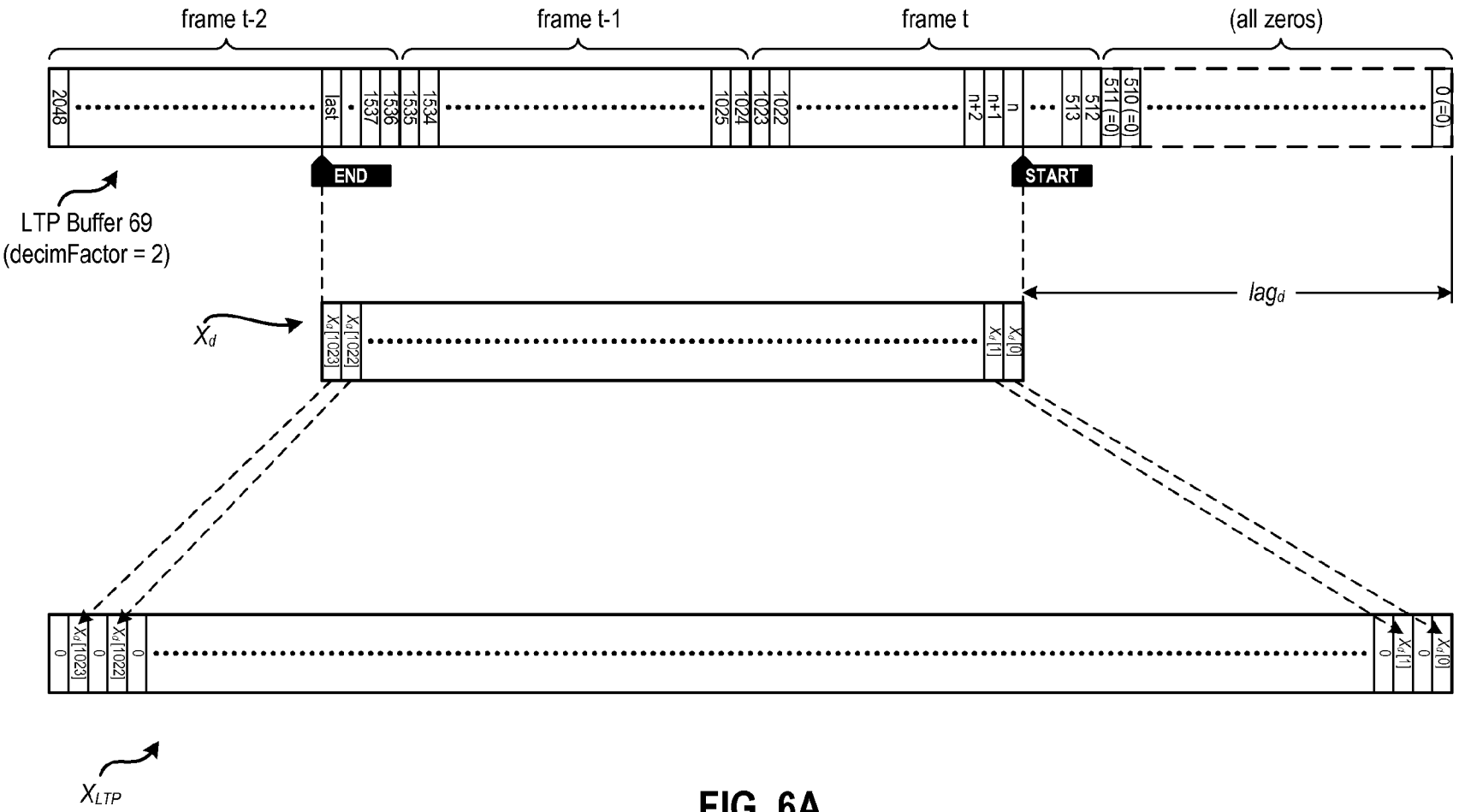
FIGS. 6A-6D show calculation of an array $X_{LTP}[\,]$ from the LTP buffer of FIG. 5 under various circumstances.

FIG. 6A shows LTP buffer 69 and data array $X_d$ in more detail. The starting point for $X_d$ is identified using $lag_d$; the end point for $X_d$ is identified based on the current decimation factor (decimFactor). The calculation of $lag_d$ is described below. In at least some embodiments, $X_d$ is implemented as an array having 1024/decimFactor elements (i.e., $X_d[0, 1, 2, \ldots (1024/decimfactor-1)]$). Array element $X_d[0]$ is filled with the sample in LTP buffer 69 after the start point (sample n in FIG. 6A), $X_d[\mathbf{1}]$ filled with the next sample (n+1), etc., with $X_d[\mathbf{1023}]$ filled with the sample "last." $X_d[\,]$ is then expanded into an array $X_{LTP}[\,]$ that has the same number of samples used by the long-term predictor in the coder (e.g., 1024 samples). So that $X_{LTP}[\,]$ will more closely resemble the samples used for prediction by the long-term predictor within the coder, the contents of $X_d[\,]$ are evenly distributed throughout $X_{LTP}[\,]$, with values of zero inserted for intervening sample slots in $X_{LTP}[\,]$. As shown in FIG. 6A, this results in $X_{LTP}[\mathbf{0}]=X_d[\mathbf{0}]$, $X_{LTP}[\mathbf{1}]=0$, $X_{LTP}[\mathbf{2}]=X_d[\mathbf{1}]$, . . . $X_{LTP}[\mathbf{1023}]=0$.

Figure 6B:
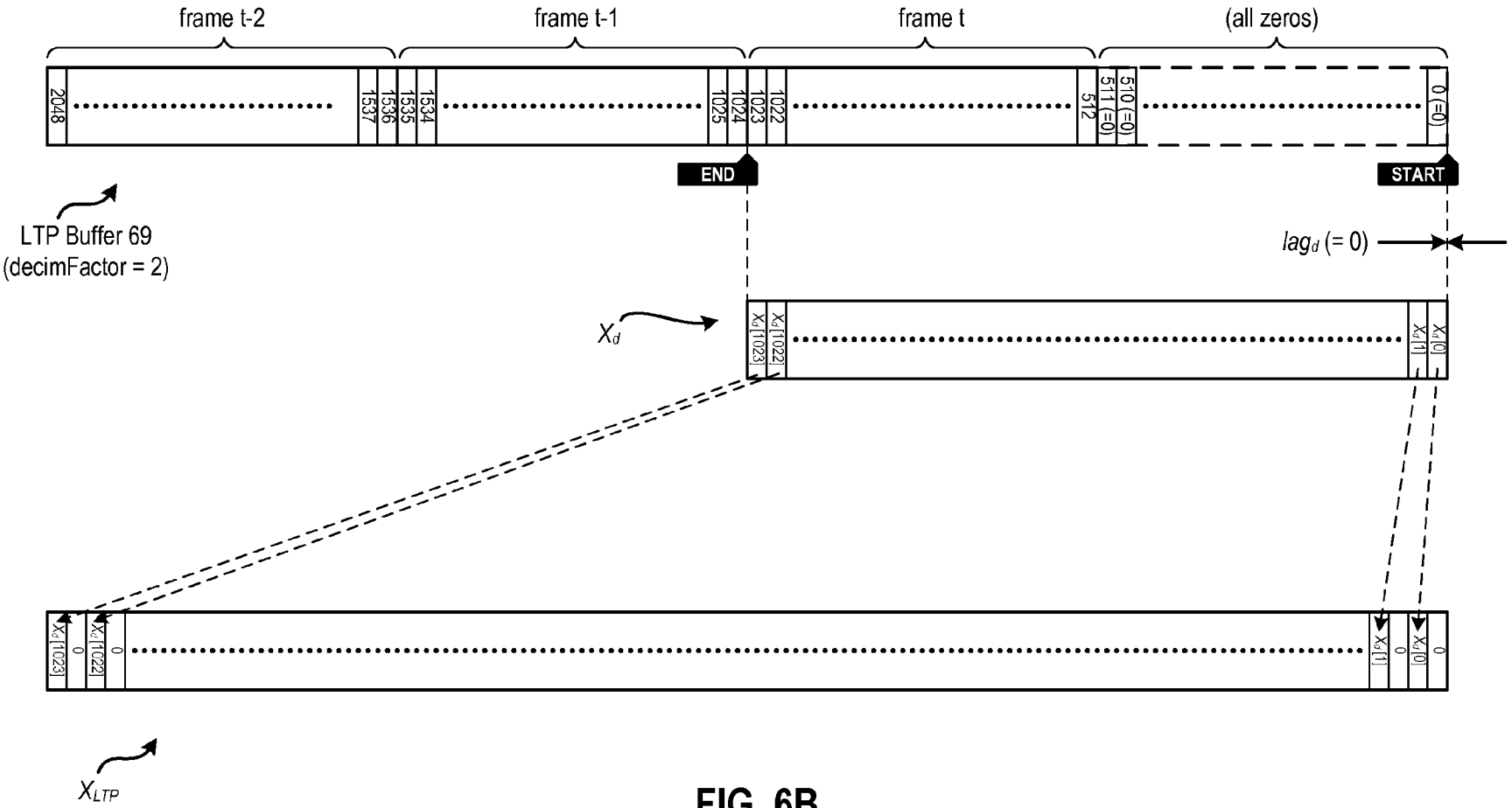
Figure 6C:
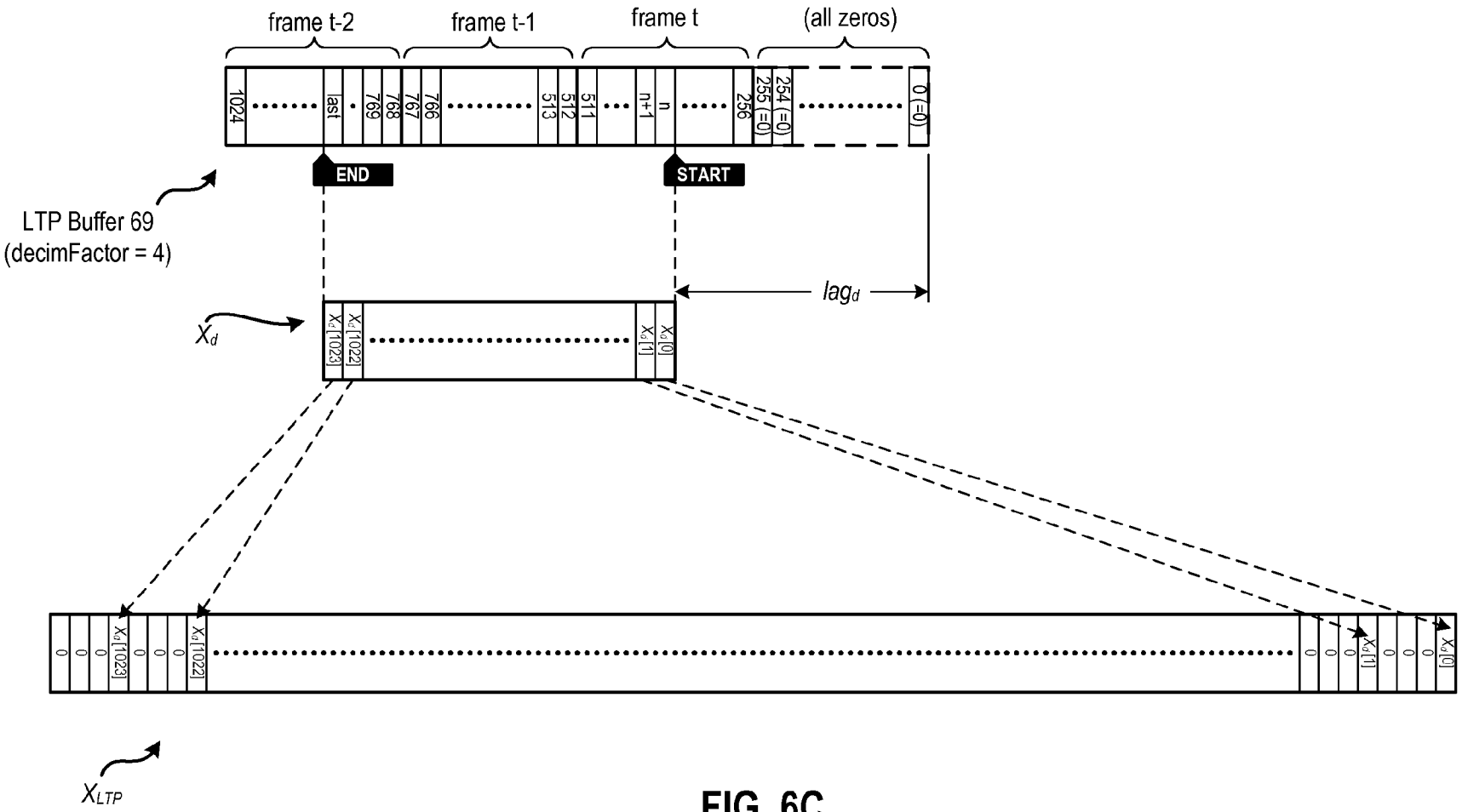
Figure 6D:
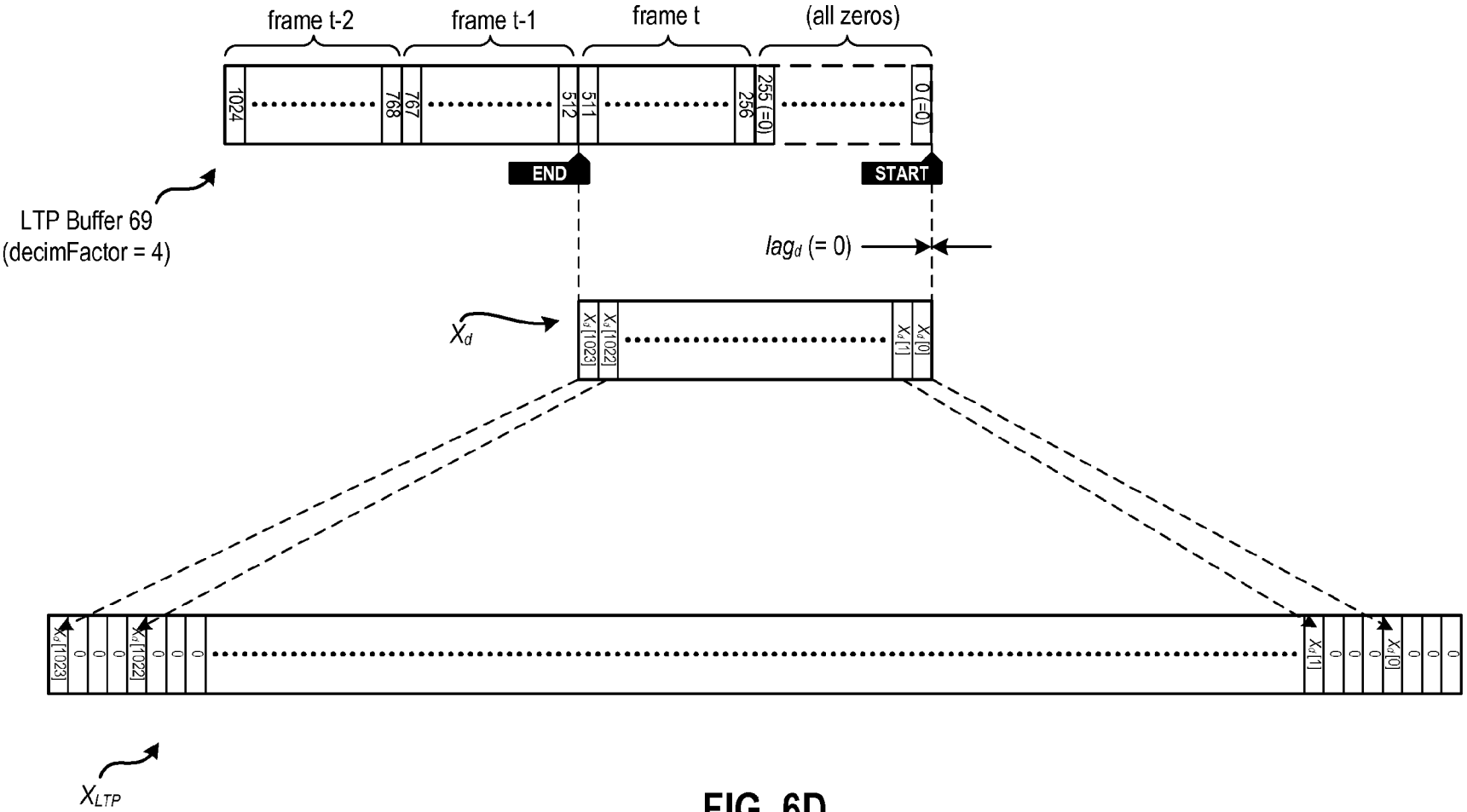

In at least some embodiments, and as shown in FIG. 6B, $X_{LTP}[\,]$ is filled in a slightly different manner when a value for the quantity lagOffset=0 (the calculation of lagOffset is described below). In such a case, the ordering of zeros and $X_d[\,]$ elements is reversed. This is done so as to yield a fully time-aligned predicted time domain signal that represents the same time-wise signal that would result if decimFactor were equal to 1. FIGS. 6C and 6D are similar to FIGS. 6A and 6B, but show generation of $X_{LTP}[\,]$ when decimFactor=4.

The samples of $X_{LTP}[\,]$ are used by pitch predictor 20 to generate a time domain prediction of the original audio signal. This prediction will approximate the prediction that is output by the long-term predictor within the coder (e.g., the signal transferred from long-term predictor 1 to MDCT 5 in FIG. 1A). The output of pitch predictor 20 is then provided to MDCT 21 for conversion to the frequency domain. In at least some embodiments, this results in an array $X_{MDCT}[\,]$ containing MDCT coefficients. As can be appreciated by persons skilled in the art, $X_{MDCT}[\,]$ will not necessarily have the same number of elements as $X_{LTP}[\,]$. The MDCT coefficients in $X_{MDCT}[\,]$ are then provided to IFSS 67. IFSS 67 then adds the coefficients of $X_{MDCT}[\,]$ to the dequantized error prediction coefficients (e.g., the output from summer 6 of FIG. 1A) in a manner described below.

Figure 7A:
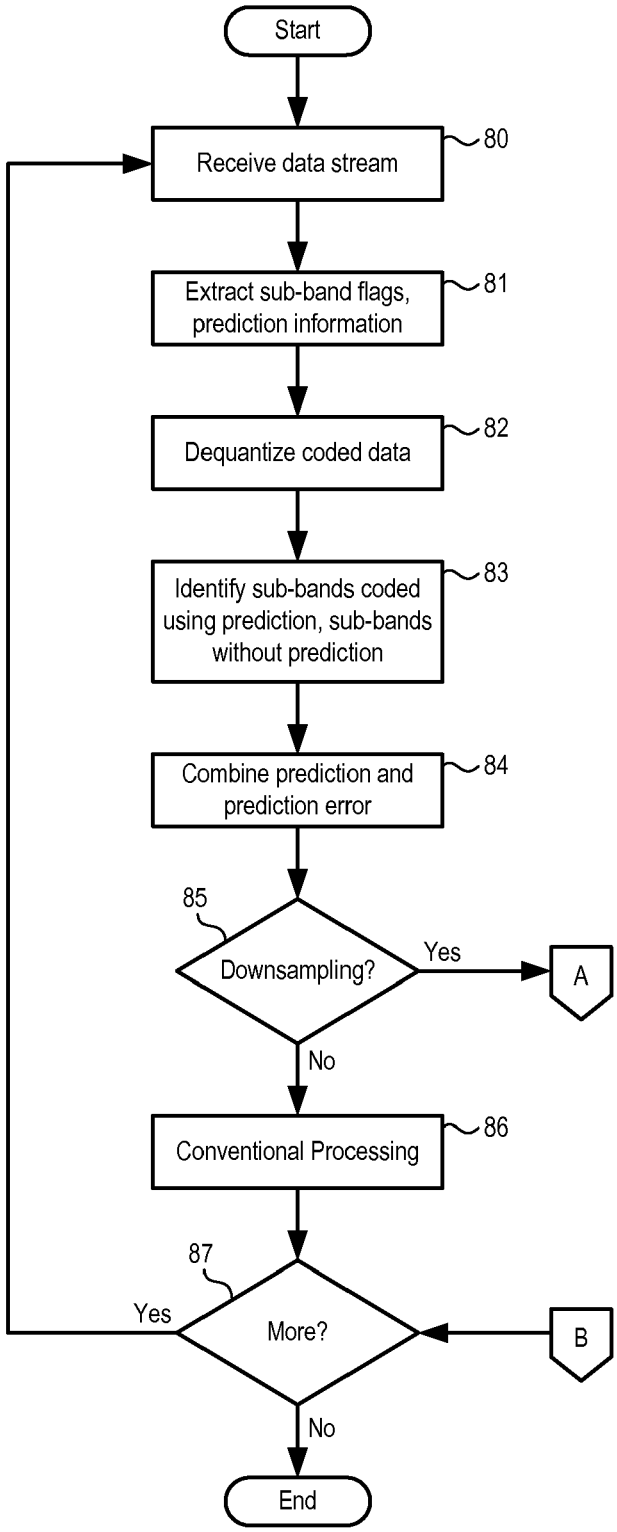
FIGS. 7A and 7B are flow charts showing operation of the decoder of FIG. 4 according to at least some embodiments.
Figure 7B:
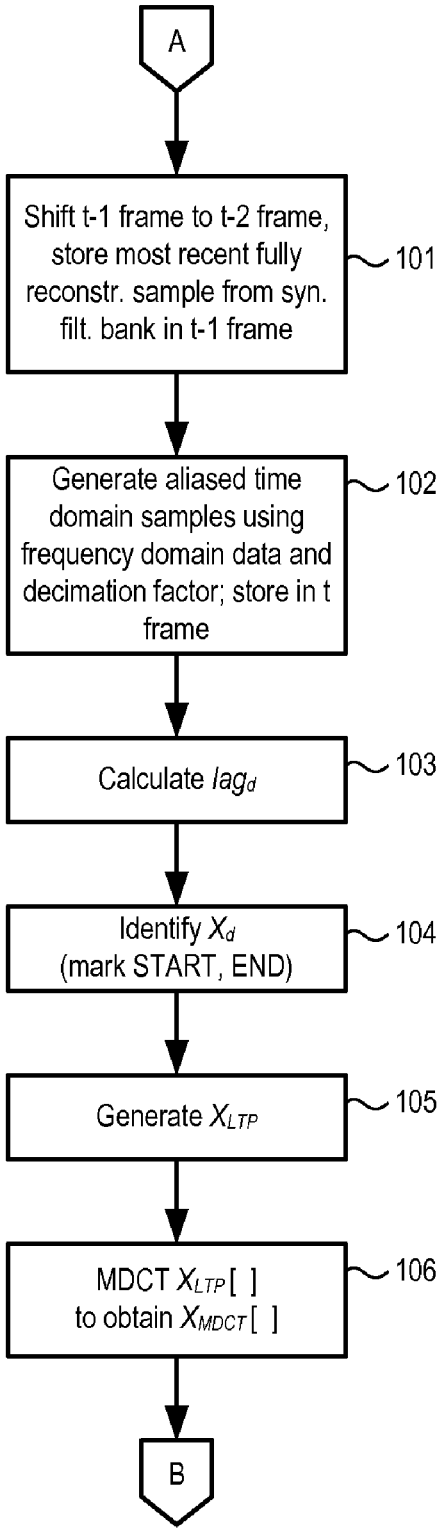

FIGS. 7A and 7B are flow charts showing operation of an AAC-LTP decoder according to at least some embodiments, and as described above in connection with FIGS. 4-6D. Decoder operation commences in FIG. 7A and proceeds to block 80, where an incoming data stream is received (e.g., by bit stream demultiplexer 15). The incoming data stream includes sub-band flags and prediction information (e.g., prediction coefficients and a pitch lag output by predictor 1 of FIG. 1A), as well as quantized frequency domain data. For some sub-bands, the frequency domain data is the result of an MDCT on an original audio input (e.g., as output by MDCT 2 of FIG. 1A). For other sub-bands, the frequency domain data are prediction error values (e.g., as output by summer 6 in FIG. 1A).

The decoder proceeds to block 81, where the sub-band flags and prediction information is extracted from received data stream. The sub-band flags are forwarded to IFSS 67 (FIG. 4), and the prediction information is forwarded to pitch predictor 20. The pitch lag is also forwarded to pre-processor 70. Returning to FIG. 7A, the decoder next proceeds to block 82, where the quantized frequency domain data is dequantized and forwarded to IFSS 67. Operation proceeds to block 83, where the decoder identifies (using the sub-band flags and IFSS 67) sub-bands that are to be reproduced using predictive data and sub bands that are to be reproduced from MDCT coefficients of the original input audio.

In block 84, and as to the sub-bands which will be reproduced using predictive data, the decoder combines the dequantized prediction error values (output from summer 6 in FIG. 1A) with frequency domain predictions based on the contents of LTP buffer 69 ($X_{MDCT}[\,]$, as described above). Specifically, the frequency domain samples from MDCT 21 ($X_{MDCT}[\,]$) are scaled and added to the prediction error values (represented for convenience as an array $X_q[\,]$). When downsampling is not occurring, the values in $X_{MDCT}[\,]$ are scaled by a factor ($c_{LTP}$) transmitted in the data stream to the decoder. When downsampling is occurring, the decoder adds $X_{MDCT}[\,]$ to $X_q[\,]$ in IFSS 67 according to the following pseudo code (which follows the syntax of the C programming language).

```
for (sfb = 0; sfb < ltp__bands; sfb++)
  if (ltp__used [sfb])
  {
    for (bin = startBinOffset [sfb]; bin < endBinOffset [sfb]; bin++)
      X_q [bin] = X_q [bin] + X_MDCT [bin] * scale;
  }
```

In the above code, "ltp_bands" is the frequency band limit for which prediction error signals can be transmitted. For embodiments implemented in connection with AAC-LTP encoding, this value is specified by the applicable MPEG-4 standard. In other words, the psychoacoustic model will typically specify sub-bands of the incoming audio signal that are to be represented by MDCT coefficients (output by MDCT 2 of FIG. 1A) or by error prediction coefficients (output by summer 6 of FIG. 1A). If each of these sub-bands is numbered 0, 1, 2, . . . k, "ltp_bands" is the highest of those numbers corresponding to a sub-band in which long-term prediction was used. The value "ltp_used[sfb]" indicates whether, for sub-band sfb, long-term prediction is enabled. In other words, ltp_used[ ] is an array of the sub-band flags input to IFSS 67 in FIG. 4. The arrays "startBinOffset[ ]" and "endBinOffset[ ]" contain starting and ending indices, respectively, for each sub-band. In particular, startBinOffset[sfb] and endBinOffset[sfb] are the respective starting and ending indices for sub-band sfb. The starting and ending indices for all sub-bands are also specified by the applicable MPEG-4 standards. The variable "scale" is either $c_{LTP}$ or an adaptive correction factor derived from the LTP coefficient and from the properties of the quantized spectra, as set forth in Equation 1.

Equation 1:

$$\text{scale} = \begin{cases} c_{LTP}, & \text{if } decimFactor == 1 \\ c2_{LTP}, & \text{otherwise} \end{cases}$$

where $$c2_{LTP} = \text{MIN}\left(1, \prod_{i=0}^{decimFactor-1} c_{LTP}\right)$$

if the quantized values for band sfb are zero, or else $$c2_{LTP}=c_{LTP}$$

As can be appreciated by persons skilled in the art, there may be no prediction values ($X_{MDCT}$[ ]) during one or more initial passes through the loop of the algorithm shown by FIG. 7A. In such cases, $X_{MDCT}$[ ] can be initially seeded with zeros.

From block 84, the decoder proceeds to block 85 and determines (e.g., based on a received decimation factor) whether downsampling is to be performed. If not, the decoder proceeds on the "No" branch to block 86 and processes the frequency domain data from IFSS 67 in a conventional manner. Preprocessor 70 (FIG. 4) is inactive when there is no downsampling, and $X_{LTP}$[ ] is obtained from LTP buffer 69 in a conventional manner. From block 86 the decoder proceeds to block 87 (described below). If at block 85 the decoder determines that downsampling is to be performed, the decoder proceeds, via off-page connector A, to FIG. 7B.

In block 101 of FIG. 7B, the decoder shifts the contents of the t−1 frame of LTP buffer 69 to the t−2 frame, and stores the samples from the most recent fully-reconstructed time domain frame (output by the synthesis filter bank) in the t−1 frame. In block 102, and using IMDCT 68, the decoder generates aliased time domain data samples using the frequency domain data from IFSS 67 and the decimation factor, and stores those aliased samples in frame t of LTP buffer 69. In block 103, the decoder calculates a value for $lag_d$ using Equations 2 and 3.

Equation 2:

$$lagOffset = \left(\text{ltp_lag} - \left\lfloor \frac{\text{ltp_lag}}{decimFactor} \right\rfloor * decimFactor\right)$$

Equation 3:

$$lag_d = \left\lfloor \frac{\text{ltp_lag}}{decimFactor} \right\rfloor + lagOffset$$

The quantity "ltp_lag" in Equations 2 and 3 is the value for pitch lag transmitted by the coder, and which value assumes the LTP buffer is of conventional size. The "⌊ ⌋" represents a floor function that returns a value representing the largest integer that is less than or equal to the floor function argument.

The decoder next proceeds to block 104 and marks the "START" and "END" points in the LTP buffer, and generates the array $X_d$[ ]. The decoder then proceeds to block 105 and generates the array $X_{LTP}$[ ] from $X_d$[ ]. Set forth below is pseudo code, generally following the syntax of the C programming language, for generating $X_{LTP}$[ ] according to at least some embodiments.

```
fullldx, predLastldx;
fullldx = (N * decimFactor) − 1;
predLastldx = N − 1;
for (i = predLastldx; i >=0; i−−)
{
  if (lagOffset)
  {
    for (j = 0; j < decimFactor −1; j++)
      X_LTP [fullldx−−] = 0;
      X_LTP [fullldx−−] = X_d [i]
  }
  else
  {
    X_LTP [fullldx−−] = X_d [i];
    for (j = 0; j < decimFactor − 1; j++)
      X_LTP [fullldx−−] = 0;
  }
}
```

The variable "N" in the above code is the size of each LTP buffer 69 frame in the presence of downsampling. For the examples of FIGS. 6A through 6D, N is equal to 1024/decimFactor. Although typical values for decimFactor are 2 and 4, other values could also be used. Similarly, the invention is not limited to use in conjunction with systems employing an LTP buffer frame size, in the absence of downsampling, of 1024 samples. The operators "−−" and "++" indicate decrementing and incrementing, respectively, during each pass through a loop.

The decoder then proceeds to block 106 and performs an MDCT upon $X_{LTP}$[ ] to obtain an array of frequency domain coefficients $X_{MDCT}$[ ]. The newly calculated $X_{MDCT}$[ ] values are forwarded to IFSS 67 for combination with prediction error values ($X_q$[ ]) to be received in a subsequent portion of the data stream. From block 106, the decoder returns (via off page connector B) to block 87 of FIG. 7A. In block 87, the decoder determines if there is additional audio data to process. If so, the decoder returns to block 80 on the "Yes" branch. Otherwise, the algorithm ends.

In at least some embodiments, the decoder is also able to accommodate "upsampling." In other words, it is sometimes desirable to increase (by interpolation of MDCT coefficients received from a coder) the number of MDCT coefficients that are used to create a time domain output signal. This may be performed, e.g., to generate a signal that is compatible with other devices. However, upsampling can also cause a mismatch between the LTP buffer in the coder and the LTP buffer in the decoder. For example, when decoding conventional AAC-LTP audio, an upsampling (or interpolation) factor of 2 will result in LTP buffer frames having 2048 samples unless additional steps are taken.

Figure 8A:
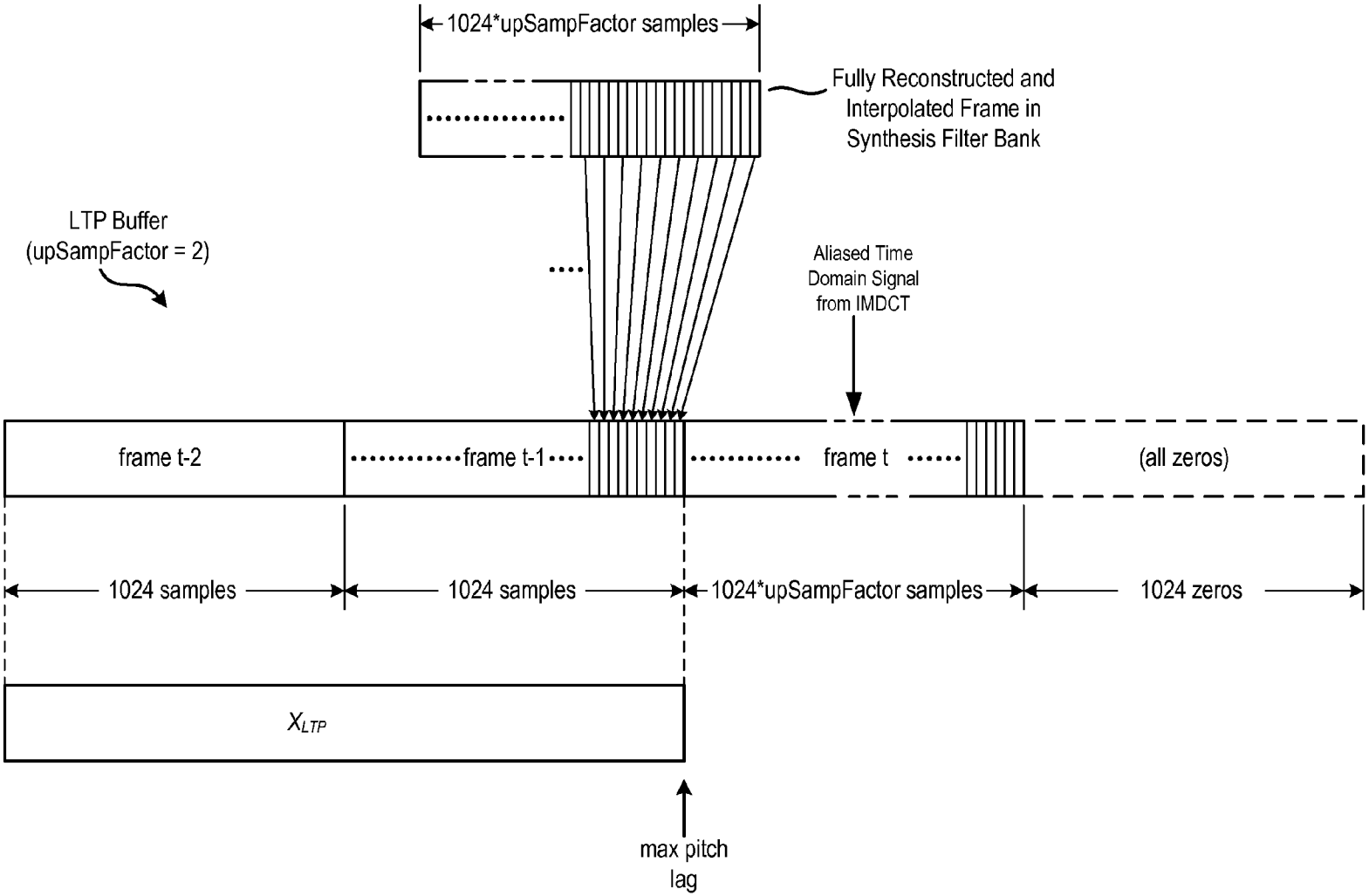
FIGS. 8A and 8B show how an LTP buffer is adapted, in at least some embodiments, to adjust for upsampling.
Figure 8B:
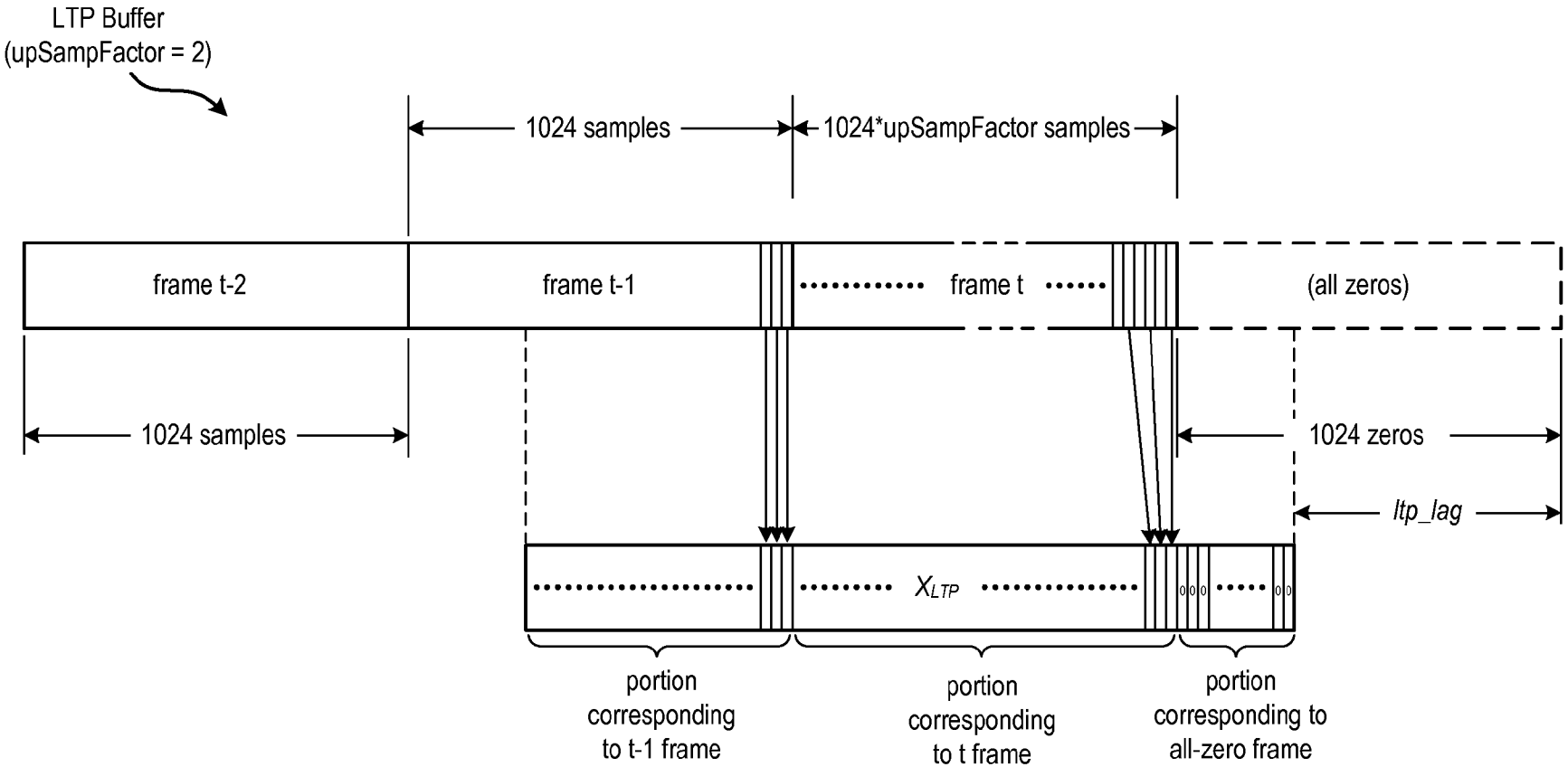

FIGS. 8A and 8B illustrates how an LTP buffer is adapted, in at least some embodiments, to adjust for upsampling. FIGS. 8A and 8B assume an upsampling (or interpolation) factor "upSampFactor" of 2, although other values could also be used. As shown in FIG. 8A, only every upSampFactor$^{th}$ sample from the fully-reconstructed frame output by the synthesis filter bank is moved into the t−1 LTP buffer frame, with the t−1 frame moved to the t−2 frame during the subsequent time period. Frame t holds the most recent aliased and interpolated time domain signal output by the IMDCT. As shown in FIG. 8A, frame t has a size of 1024*upSampFactor. In at least some implementations, the t frame is not part of the LTP buffer. The aliased time domain IMDCT output is instead buffered elsewhere within the decoder. In such implementations, access to the data represented by the t frame is achieved by address pointers to memory locations used to buffer the aliased and interpolated IMDCT output during overlap-add. A similar point arrangement could be implemented for the t frame in the embodiments of FIGS. 4-7B.

When pitch lag is at its maximum value, and as shown in FIG. 8A, $X_{LTP}$[ ] is obtained directly from the t−1 and t−2 frames. When pitch lag is less than maximum, and as shown in FIG. 8B, the portion of $X_{LTP}$[ ] extending beyond the t frame is filled directly from the t−1 frame and (in some cases) the t−2 frame. The portion of $X_{LTP}$[ ] corresponding to the all-zero "frame" is filled with zeros. The portion of $X_{LTP}$[ ] corresponding to the t frame is filled by taking every upSampFactor$^{th}$ sample from the t frame. For simplicity, transfer of samples to the t and the t−1 frame is not shown in FIG. 8B.

Figure 9A:
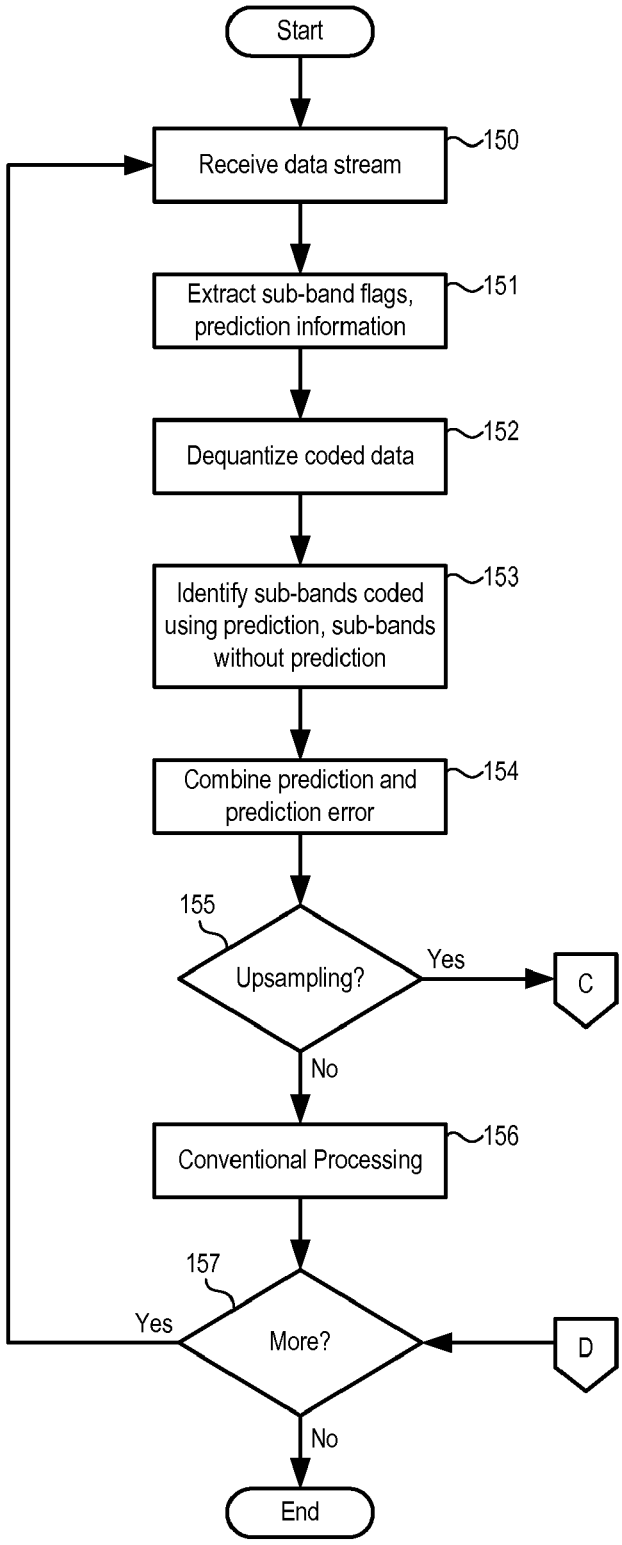
FIGS. 9A and 9B are flow charts showing operation of a decoder, according to at least some embodiments, when upsampling is taking place.
Figure 9B:
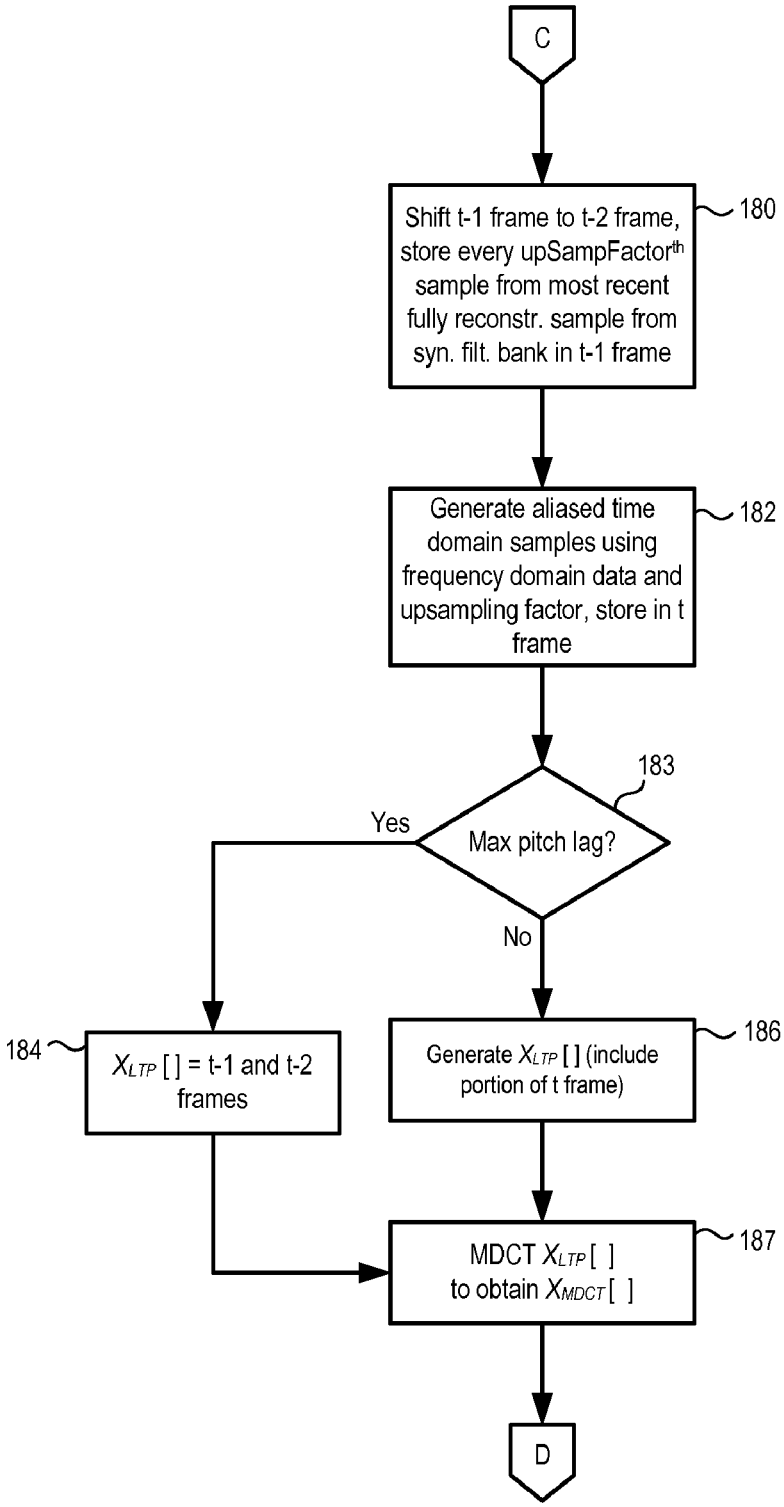

FIGS. 9A and 9B are flow charts showing operation of an AAC-LTP decoder, according to at least some embodiments, when upsampling is taking place. The operations corresponding to blocks 150-153, 156 and 157 are generally the same as those corresponding to blocks 80-83, 86 and 87 described in connection with FIG. 7A, and thus not further discussed. The operations corresponding to block 154 are similar to those of block 84, except with regard to scaling of $X_{MDCT}[\ ]$ values when upsampling is taking place. Within IFSS 67' (see FIG. 10, discussed below), the decoder adds $X_{MDCT}[\ ]$ to X [ ] according to the same pseudo code discussed above for block 84 of FIG. 7A. In the algorithm of FIG. 9A, however, the variable "scale" is set to $c_{LTP}$*upSampFactor. Block 155 is also similar to block 85 of FIG. 7A, except that the decoder determines in block 155 (e.g., based on a received upsampling or interpolation factor) whether upsampling is to be performed. If so, the decoder proceeds via off-page connector C, to FIG. 9B.

In block 180 of FIG. 9B, the decoder shifts the contents of the t−1 frame of LTP buffer 69' (FIG. 10) to the t−2 frame. The decoder also stores every upSampFactor$^{th}$ sample from the most recent fully-reconstructed time domain sample (from the synthesis filter bank) in the t−1 frame. In block 182, the decoder generates interpolated and aliased time domain data samples using the frequency domain data from IFSS 67' and the upsampling factor, and stores those aliased samples in frame t. In block 183, the decoder determines if pitch lag (ltp_lag) is at its maximum value. If so, the decoder proceeds on the "Yes" branch to block 184, where $X_{LTP}[\ ]$ is filled from the t−1 and t−2 buffer frames. From block 184, the decoder then proceeds to block 187 (discussed below).

If pitch lag is less than maximum, the decoder proceeds on the "No" branch from block 183 to block 186. In block 186, $X_{LTP}[\ ]$ is generated using the ltp_lag value transmitted from the decoder. For portions of $X_{LTP}[\ ]$ that correspond to the t frame, only every upSampFactor$^{th}$ sample is copied to $X_{LTP}[\ ]$. From block 186, the decoder proceeds to block 187 and performs an MDCT upon $X_{LTP}[\ ]$ to obtain an array of frequency domain coefficients $X_{MDCT}[\ ]$. From block 187, the decoder returns to block 157 (FIG. 9A) via off-page connector D.

Figure 10:
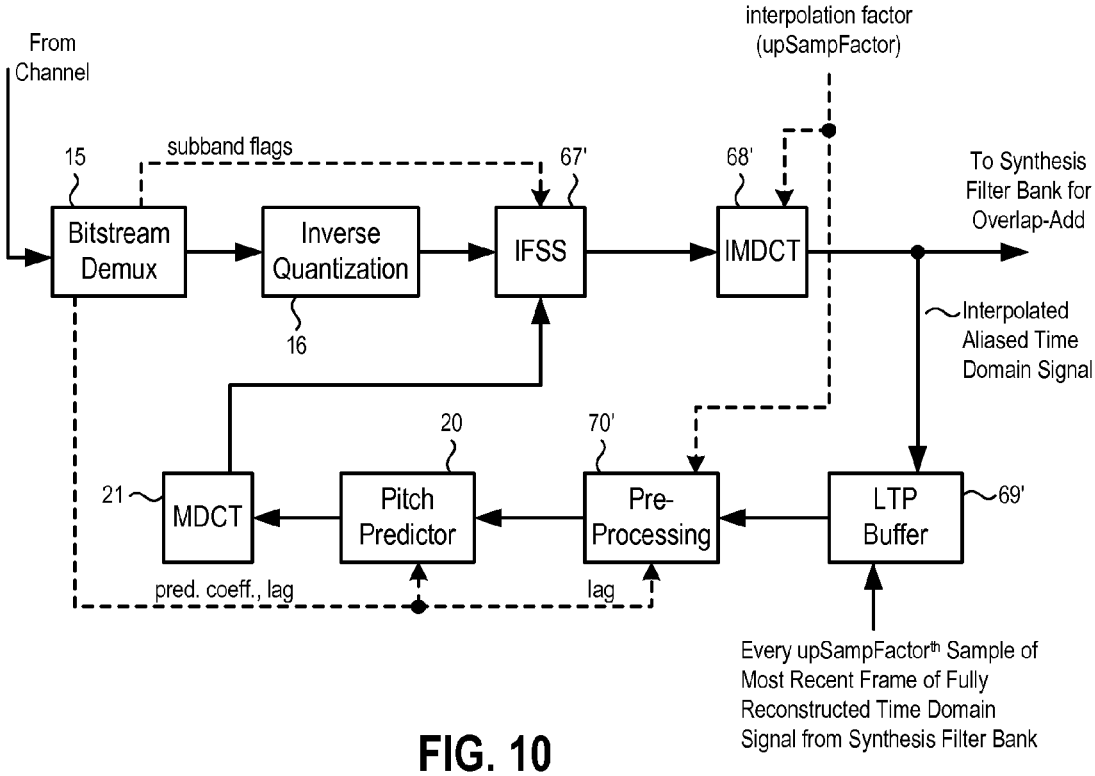
FIG. 10 is block diagram of a decoder, according to at least some embodiments, adapted to accommodate upsampling.
Figure 11:
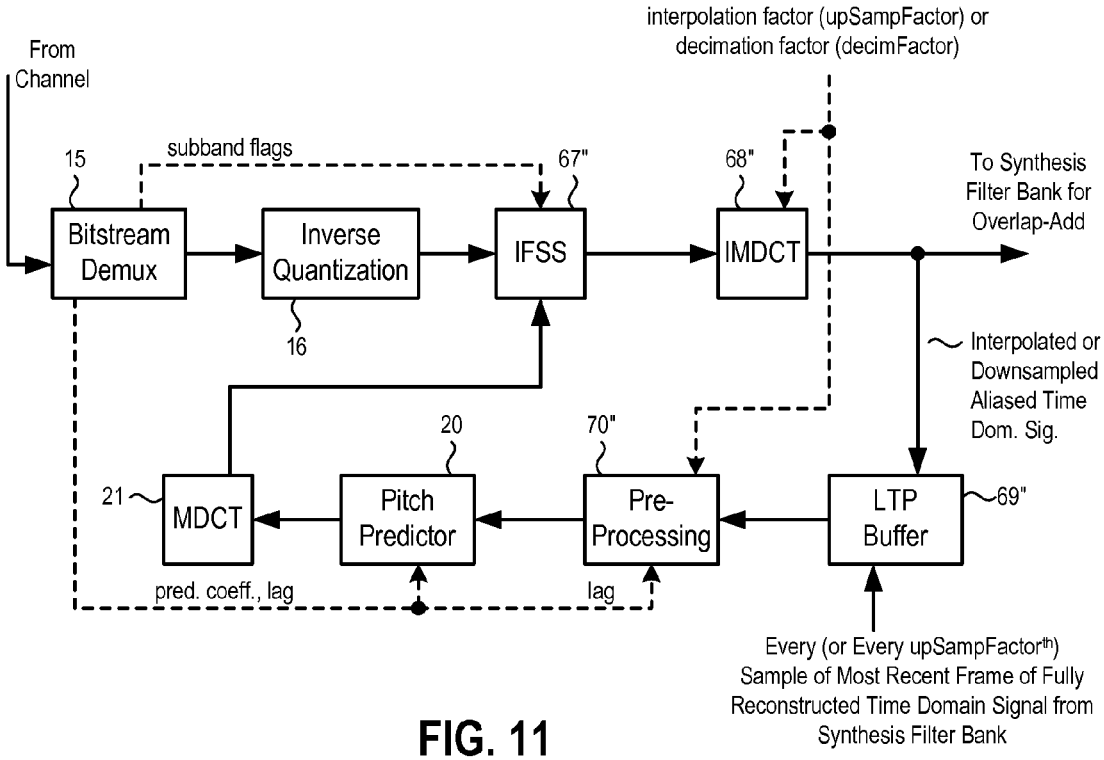
FIG. 11 is block diagram of a decoder, according to at least some embodiments, adapted to accommodate both upsampling and downsampling.

FIG. 10 is a block diagram of a decoder, according to at least some embodiments, configured to perform the operations of FIGS. 9A and 9B. Components 15, 16, 20 and 21 are similar to like-numbered components described in conjunction with FIGS. 1B and 4. Components 67', 68', 69' and 70' are similar to components 67, 68, 69 and 70 of FIG. 4, but are configured to accommodate upsampling in the manner described above in conjunction with FIGS. 8A-9B. FIG. 11 is a block diagram of a decoder, according to at least some additional embodiments, configured to accommodate both upsampling and downsampling. Components 15, 16, 20 and 21 are similar to like-numbered components described in conjunction with FIGS. 1B, 4 and 10. Components 67", 68", 69" and 70" are similar to components 67, 68, 69 and 70 of FIG. 4, but are also configured to accommodate upsampling in the manner described above in conjunction with FIGS. 8A-9B.

Although specific examples of carrying out the invention have been described, those skilled in the art will appreciate that there are numerous variations and permutations of the above-described systems and methods that are contained within the spirit and scope of the invention as set forth in the appended claims. For example, the invention may also be implemented as a machine-readable medium (e.g., RAM, ROM, a separate flash memory, etc.) having machine-executable instructions stored thereon such that, when the instructions are read and executed by an appropriate device (or devices), steps of a method according to the invention are performed. As yet another example, decoders such as are described above could also be implemented in numerous other types of devices (e.g., portable music players and other types of consumer electronic devices). These and other modifications are within the scope of the invention as set forth in the attached claims. In the claims, various portions are prefaced with letter or number references for convenience. However, use of such references does not imply a temporal relationship not otherwise required by the language of the claims.

The invention claimed is:

1. A method comprising:

receiving a stream containing coded data and predictive information associated with the coded data, the predictive information having been generated based on data in a predictive coding buffer;

receiving a factor indicative of an amount by which the coded data is to be either upsampled or downsampled as part of decoding the coded data;

generating decoded data from the coded data using the received factor and the predictive information;

buffering at least a portion of the decoded data in one or more buffers, at least one of the one or more buffers having at least one dimension different from a corresponding dimension of the prediction coding buffer;

identifying at least a portion of the buffered decoded data for use in decoding subsequent coded data; and modifying the identified data to correspond to the at least one prediction coding buffer dimension.

2. The method of claim 1, wherein the coded data includes frequency domain data generated using one or more modified discrete cosine transforms, and said generating decoded data step includes generating time domain data from the frequency domain data using one or more inverse modified discrete cosine transforms.

3. The method of claim 2, wherein the predictive information includes a pitch lag value, and said identifying at least a portion step includes calculating a modified pitch lag value.

4. The method of claim 3, wherein the factor received in said receiving a factor step is a decimation factor indicative of downsampling, and said identifying at least a portion step includes calculating the modified pitch lag value based on $$lagOffset = \left(\text{ltp_lag} - \left\lfloor \frac{\text{ltp_lag}}{decimFactor} \right\rfloor * decimFactor\right)$$

and $$lag_d = \left\lfloor \frac{\text{ltp_lag}}{decimFactor} \right\rfloor + lagOffset,$$

where $lag_d$ is the modified pitch lag value, ltp_lag is the pitch lag value included in the received predictive information, and decimFactor is the decimation factor.

5. The method of claim 4, wherein said modifying the identified data step includes interleaving zero values between elements of the identified data.

6. The method of claim 3, wherein said modifying the identified data step includes interleaving zero values between elements of the identified data.

7. The method of claim 2, wherein the coded data includes prediction error coefficients, and said generating decoded data step includes performing a modified discrete cosine transform upon modified identified data from an earlier performance of said modifying the identified data step, scaling the data resulting from said performing a modified discrete cosine transform step, and adding the scaled data from said scaling the data step to the prediction error coefficients.

8. The method of claim 7, wherein the coded data includes frequency sub-bands, wherein said scaling the data step includes, as to each sub-band, scaling the data resulting from said performing a modified discrete cosine transform step according to $$\text{scale} = \begin{cases} c_{LTP}, & \text{if } decimFactor = 1 \\ c2_{LTP}, & \text{otherwise} \end{cases}$$

where scale is a scaling factor applied to elements of the data from said performing a modified discrete cosine transform step, decimFactor is the factor received in said receiving a factor step and indicative of downsampling, $c_{LTP}$ is an LTP coefficient included in the stream received in said receiving a stream step, $$c2_{LTP} = \text{MIN}\left(1, \prod_{i=0}^{decimFactor-1} c_{LTP}\right)$$

if the quantized values for the sub-band are zero, or else $c2_{LTP}=c_{LTP}$.

9. The method of claim 1, wherein the factor received in said receiving a factor step is an upsampling factor (upSampFactor), said buffering at least a portion step includes buffering a frame t holding N*upSampFactor aliased time domain samples, N is the corresponding prediction coding buffer dimension, and said buffering at least a portion step further includes buffering a frame t−1 by transferring every upSampFactor$^{th}$ sample from a fully-reconstructed time domain frame for a recent time period to the frame t−1.

10. The method of claim 9, wherein the coded data includes frequency domain data generated using one or more modified discrete cosine transforms, said generating decoded data step includes generating time domain data from the frequency domain data using one or more inverse modified discrete cosine transforms, the coded data includes prediction error coefficients, and said generating decoded data step further includes performing a modified discrete cosine transform upon modified identified data from an earlier performance of said modifying the identified data step, scaling the data resulting from said performing a modified discrete cosine transform step by a factor $c_{LTP}$*upSampFactor, where $c_{LTP}$ is an LTP coefficient included in the stream received in said receiving a stream step, and adding the scaled data from said scaling the data step to the prediction error coefficients.

11. A machine-readable medium having machine-executable instructions for performing a method comprising:

receiving a stream containing coded data and predictive information associated with the coded data, the predictive information having been generated based on data in a predictive coding buffer;

receiving a factor indicative of an amount by which the coded data is to be either upsampled or downsampled as part of decoding the coded data;

generating decoded data from the coded data using the received factor and the predictive information;

buffering at least a portion of the decoded data in one or more buffers, at least one of the one or more buffers having at least one dimension different from a corresponding dimension of the prediction coding buffer;

identifying at least a portion of the buffered decoded data for use in decoding subsequent coded data; and modifying the identified data to correspond to the at least one prediction coding buffer dimension.

12. The machine-readable medium of claim 11, wherein the coded data includes frequency domain data generated using one or more modified discrete cosine transforms, and said generating decoded data step includes generating time domain data from the frequency domain data using one or more inverse modified discrete cosine transforms.

13. The machine-readable medium of claim 12, wherein the predictive information includes a pitch lag value, and said identifying at least a portion step includes calculating a modified pitch lag value.

14. The machine-readable medium of claim 13, wherein the factor received in said receiving a factor step is a decimation factor indicative of downsampling, and said identifying at least a portion step includes calculating the modified pitch lag value based on $$lagOffset = \left(\text{ltp_lag} - \left\lfloor \frac{\text{ltp_lag}}{decimFactor} \right\rfloor * decimFactor\right)$$

and $$lag_d = \left\lfloor \frac{\text{ltp_lag}}{decimFactor} \right\rfloor + lagOffset,$$

where $lag_d$ is the modified pitch lag value, ltp _lag is the pitch lag value included in the received predictive information, and decimFactor is the decimation factor.

15. The machine-readable medium of claim 14, wherein said modifying the identified data step includes interleaving zero values between elements of the identified data.

16. The machine-readable medium of claim 13, wherein said modifying the identified data step includes interleaving zero values between elements of the identified data.

17. The machine-readable medium of claim 12, wherein the coded data includes prediction error coefficients, and said generating decoded data step includes performing a modified discrete cosine transform upon modified identified data from an earlier performance of said modifying the identified data step, scaling the data resulting from said performing a modified discrete cosine transform step, and adding the scaled data from said scaling the data step to the prediction error coefficients.

18. The machine-readable medium of claim 17, wherein the coded data includes frequency sub-bands, wherein said scaling the data step includes, as to each sub-band, scaling the data resulting from said performing a modified discrete cosine transform step according to $$\text{scale} = \begin{cases} c_{LTP}, & \text{if } decimFactor = 1 \\ c2_{LTP}, & \text{otherwise} \end{cases}$$

where scale is a scaling factor applied to elements of the data from said performing a modified discrete cosine transform step, decimFactor is the factor received in said receiving a factor step and indicative of downsampling, $c_{LTP}$ is an LTP coefficient included in the stream received in said receiving a stream step, $$c2_{LTP} = \text{MIN}\left(1, \prod_{i=0}^{decimFactor-1} c_{LTP}\right)$$

if the quantized values for the sub-band are zero, or else $c2_{LTP}=c_{LTP}$.

19. The machine-readable medium of claim 11, wherein the factor received in said receiving a factor step is an upsampling factor (upSampFactor), said buffering at least a portion step includes buffering a frame t holding N*upSampFactor aliased time domain samples, N is the corresponding prediction coding buffer dimension, and said buffering at least a portion step further includes buffering a frame t−1 by transferring every upSampFactor$^{th}$ sample from a fully-reconstructed time domain frame for a recent time period to the frame t−1.

20. The machine-readable medium of claim 19, wherein the coded data includes frequency domain data generated using one or more modified discrete cosine transforms, said generating decoded data step includes generating time domain data from the frequency domain data using one or more inverse modified discrete cosine transforms, the coded data includes prediction error coefficients, and said generating decoded data step further includes performing a modified discrete cosine transform upon modified identified data from an earlier performance of said modifying the identified data step, scaling the data resulting from said performing a modified discrete cosine transform step by a factor $c_{LTP}$*upSampFactor, where $c_{LTP}$ is an LTP coefficient included in the stream received in said receiving a stream step, and adding the scaled data from said scaling the data step to the prediction error coefficients.

21. An apparatus, comprising:

one or more processors configured to perform a method for processing data, the method including receiving a stream containing coded data and predictive information associated with the coded data, the predictive information having been generated based on data in a predictive coding buffer, receiving a factor indicative of an amount by which the coded data is to be either upsampled or downsampled as part of decoding the coded data, generating decoded data from the coded data using the received factor and the predictive information, buffering at least a portion of the decoded data in one or more buffers, at least one of the one or more buffers having at least one dimension different from a corresponding dimension of the prediction coding buffer, identifying at least a portion of the buffered decoded data for use in decoding subsequent coded data, and modifying the identified data to correspond to the at least one prediction coding buffer dimension.

22. The apparatus of claim 21, wherein the coded data includes frequency domain data generated using one or more modified discrete cosine transforms, and said generating decoded data step includes generating time domain data from the frequency domain data using one or more inverse modified discrete cosine transforms.

23. The apparatus of claim 22, wherein the predictive information includes a pitch lag value, and said identifying at least a portion step includes calculating a modified pitch lag value.

24. The apparatus of claim 23, wherein the factor received in said receiving a factor step is a decimation factor indicative of downsampling, and said identifying at least a portion step includes calculating the modified pitch lag value based on $$lagOffset = \left(\text{ltp_lag} - \left\lfloor \frac{\text{ltp_lag}}{decimFactor} \right\rfloor * decimFactor\right)$$

and $$lag_d = \left\lfloor \frac{\text{ltp_lag}}{decimFactor} \right\rfloor + lagOffset,$$

where $lag_d$ is the modified pitch lag value, ltp_lag is the pitch lag value included in the received predictive information, and decimFactor is the decimation factor.

25. The apparatus of claim 24, wherein said modifying the identified data step includes interleaving zero values between elements of the identified data.

26. The apparatus of claim 23, wherein said modifying the identified data step includes interleaving zero values between elements of the identified data.

27. The apparatus of claim 22, wherein the coded data includes prediction error coefficients, and said generating decoded data step includes performing a modified discrete cosine transform upon modified identified data from an earlier performance of said modifying the identified data step, scaling the data resulting from said performing a modified discrete cosine transform step, and adding the scaled data from said scaling the data step to the prediction error coefficients.

28. The apparatus of claim 27, wherein the coded data includes frequency sub-bands, wherein said scaling the data step includes, as to each sub-band, scaling the data resulting from said performing a modified discrete cosine transform step according to $$\text{scale} = \begin{cases} c_{LTP}, & \text{if } decimFactor = 1 \\ c2_{LTP}, & \text{otherwise} \end{cases}$$

where scale is a scaling factor applied to elements of the data from said performing a modified discrete cosine transform step, decimFactor is the factor received in said receiving a factor step and indicative of downsampling, $c_{LTP}$ is an LTP coefficient included in the stream received in said receiving a stream step, $$c2_{LTP} = \mathrm{MIN}\left(1, \prod_{i=0}^{decimFactor-1} c_{LTP}\right)$$

if the quantized values for the sub-band are zero, or else $c2_{LTP}=c_{LTP}$.

29. The apparatus of claim 21, wherein the factor received in said receiving a factor step is an upsampling factor (upSampFactor), said buffering at least a portion step includes buffering a frame t holding N*upSampFactor aliased time domain samples, N is the corresponding prediction coding buffer dimension, and said buffering at least a portion step further includes buffering a frame t−1 by transferring every upSampFactor$^{th}$ sample from a fully-reconstructed time domain frame for a recent time period to the frame t−1.

30. The apparatus of claim 29, wherein the coded data includes frequency domain data generated using one or more modified discrete cosine transforms, said generating decoded data step includes generating time domain data from the frequency domain data using one or more inverse modified discrete cosine transforms, the coded data includes prediction error coefficients, and said generating decoded data step further includes performing a modified discrete cosine transform upon modified identified data from an earlier performance of said modifying the identified data step, scaling the data resulting from said performing a modified discrete cosine transform step by a factor $c_{LTP}$*upSampFactor, where $c_{LTP}$ is an LTP coefficient included in the stream received in said receiving a stream step, and adding the scaled data from said scaling the data step to the prediction error coefficients.

31. The apparatus of claim 21, wherein the apparatus is a mobile communication device.

32. The apparatus of claim 21, wherein the apparatus is a computer.

33. The apparatus of claim 21, wherein the apparatus is a portable music player.

34. The apparatus of claim 21, comprising:

means for conversion for frequency domain samples coding N time domain samples to N*F time domain samples, wherein F is an upsampling or a downsampling factor, prediction means, and means for adapting the output of the means for conversion for use in the prediction means.

35. The apparatus of claim 34, wherein

F is an upsampling factor, and the means for adaptation is configured to update a frame of a long-term prediction buffer with every F$^{th}$ sample from a fully-reconstructed time domain output frame.

36. The apparatus of claim 34, wherein

F is a downsampling factor, and the means for adaptation is configured to expand 2N*F time domain samples in a portion of a long-term buffer to 2N time domain samples.

37. An apparatus, comprising:

one or more integrated circuits configured to perform a method, the method including receiving a stream containing coded data and predictive information associated with the coded data, the predictive information having been generated based on data in a predictive coding buffer, receiving a factor indicative of an amount by which the coded data is to be either upsampled or downsampled as part of decoding the coded data, generating decoded data from the coded data using the received factor and the predictive information, buffering at least a portion of the decoded data in one or more buffers, at least one of the one or more buffers having at least one dimension different from a corresponding dimension of the prediction coding buffer, identifying at least a portion of the buffered decoded data for use in decoding subsequent coded data, and modifying the identified data to correspond to the at least one prediction coding buffer dimension.

* * * * *